US011205834B2

(12) United States Patent
Ayala Vazquez et al.

(10) Patent No.: US 11,205,834 B2
(45) Date of Patent: Dec. 21, 2021

(54) ELECTRONIC DEVICE ANTENNAS HAVING SWITCHABLE FEED TERMINALS

(71) Applicant: Apple Inc., Cupertino, CA (US)

(72) Inventors: Enrique Ayala Vazquez, Watsonville, CA (US); Hongfei Hu, Cupertino, CA (US); Mattia Pascolini, San Francisco, CA (US); Nanbo Jin, San Jose, CA (US); Kevin M. Froese, San Francisco, CA (US); Erica J. Tong, Pacifica, CA (US); Xu Han, San Jose, CA (US)

(73) Assignee: Apple Inc., Cupertino, CA (US)

( * ) Notice: Subject to any disclaimer, the term of this patent is extended or adjusted under 35 U.S.C. 154(b) by 300 days.

(21) Appl. No.: 16/019,322

(22) Filed: Jun. 26, 2018

(65) Prior Publication Data

US 2019/0393586 A1 Dec. 26, 2019

(51) Int. Cl.

| | |
|---|---|
| ***H01Q 1/24*** | (2006.01) |
| ***H01Q 1/48*** | (2006.01) |
| ***H01Q 13/10*** | (2006.01) |
| ***H01Q 5/328*** | (2015.01) |

(52) U.S. Cl.

CPC ..... *H01Q 1/242* (2013.01); *H01Q 1/48* (2013.01); *H01Q 5/328* (2015.01); *H01Q 13/103* (2013.01)

(58) Field of Classification Search

CPC ..... H01Q 21/28; H01Q 1/48; H01Q 9/42; H01Q 5/328; H01Q 1/243; H01Q 13/103; H01Q 1/242

See application file for complete search history.

(56) References Cited

U.S. PATENT DOCUMENTS

| | | | | |
|---|---|---|---|---|
| 9,190,712 | B2 | 11/2015 | Hu et al. | |
| 9,768,506 | B2 | 9/2017 | Krogerus | |
| 9,923,272 | B2 | 3/2018 | Sorensen et al. | |
| 10,158,384 | B1 * | 12/2018 | Yarga | H01Q 13/103 |
| 10,200,092 | B1 * | 2/2019 | Irei | H04B 5/02 |
| 10,804,617 | B2 * | 10/2020 | Zhou | H01Q 9/0421 |

(Continued)

FOREIGN PATENT DOCUMENTS

| | | | |
|---|---|---|---|
| CN | 105281800 | A | 1/2016 |
| CN | 105826652 | A | 8/2016 |

(Continued)

*Primary Examiner* — Graham P Smith
*Assistant Examiner* — Jae K Kim
(74) *Attorney, Agent, or Firm* — Treyz Law Group, P.C.; Michael H. Lyons; Tianyi He

(57) ABSTRACT

An electronic device may include a conductive housing and an antenna. The antenna may include an arm formed from a first segment of the housing. A gap may separate the first segment from a second segment. The antenna may include a feed coupled to a transmission line having a signal conductor. The feed may include first and second positive terminals on the first segment and a third positive terminal on the second segment. An adjustable component may be coupled between the first and third terminals. The signal conductor may be coupled to the first terminal. A wide conductive trace may be coupled between the signal conductor and the second terminal. A switch may be interposed on the signal conductor. The second terminal may cover a cellular low band when the switch is open. The first terminal may cover the cellular low band and higher bands when the switch is closed.

20 Claims, 11 Drawing Sheets

(56) References Cited

U.S. PATENT DOCUMENTS

2011/0175789 A1 7/2011 Lee et al.
2011/0241949 A1* 10/2011 Nickel ..... H01Q 1/243 343/702
2012/0112969 A1* 5/2012 Caballero ..... H04M 1/0266 343/702
2012/0229347 A1* 9/2012 Jin ..... H01Q 5/307 343/702
2013/0050046 A1 2/2013 Jarvis et al.
2013/0169490 A1* 7/2013 Pascolini ..... H01Q 1/243 343/702
2013/0194139 A1* 8/2013 Nickel ..... H01Q 5/328 343/703
2013/0201067 A1* 8/2013 Hu ..... H01Q 9/0421 343/745
2013/0203364 A1* 8/2013 Darnell ..... H01Q 5/35 455/77
2013/0257659 A1* 10/2013 Darnell ..... H05K 1/181 343/702
2014/0078008 A1* 3/2014 Kang ..... H01Q 13/10 343/702
2014/0085160 A1 3/2014 Valkonen et al.
2014/0159982 A1 6/2014 De Luis et al.
2014/0266922 A1* 9/2014 Jin ..... H01Q 5/314 343/702
2014/0266923 A1* 9/2014 Zhou ..... H01Q 9/06 343/702
2014/0266938 A1* 9/2014 Ouyang ..... H01Q 5/378 343/729
2014/0274231 A1 9/2014 De Luis et al.
2014/0292598 A1* 10/2014 Bevelacqua ..... H01Q 9/0442 343/745
2014/0306857 A1* 10/2014 Bevelacqua ..... H01Q 9/0442 343/750
2014/0323063 A1* 10/2014 Xu ..... H01Q 9/0442 455/77
2014/0329558 A1* 11/2014 Darnell ..... H04B 1/0458 455/553.1
2014/0333496 A1* 11/2014 Hu ..... H01Q 9/0421 343/745
2015/0249292 A1* 9/2015 Ouyang ..... H01Q 1/48 343/702
2015/0249485 A1* 9/2015 Ouyang ..... H04B 5/0081 455/41.1
2015/0280771 A1* 10/2015 Mow ..... H04B 1/40 455/77
2016/0056527 A1* 2/2016 Pascolini ..... H01Q 9/42 343/702
2016/0064801 A1* 3/2016 Han ..... H01Q 5/328 343/702
2016/0064812 A1* 3/2016 Han ..... H01Q 1/52 343/702
2016/0064820 A1 3/2016 Kim et al.
2016/0093955 A1* 3/2016 Ayala Vazquez ..... H01Q 9/42 343/702
2016/0097833 A1* 4/2016 Han ..... G01R 29/0878 343/702
2016/0344439 A1 11/2016 Seol et al.
2017/0033441 A1* 2/2017 Son ..... H01Q 5/364
2017/0033460 A1* 2/2017 Ayala Vazquez .... H01Q 13/103
2017/0048363 A1 2/2017 Lee et al.
2017/0201010 A1* 7/2017 Kim ..... H01Q 7/00
2017/0264721 A1 9/2017 Yli-Peltola
2018/0034135 A1 2/2018 Kwak et al.
2018/0083344 A1 3/2018 Han et al.
2018/0115053 A1 4/2018 Hu et al.
2019/0027833 A1* 1/2019 Ayala Vazquez ..... H01Q 9/42

FOREIGN PATENT DOCUMENTS

CN 106169641 A 11/2016
CN 107959103 A 4/2018
CN 207303337 U 5/2018
CN 108134202 A 6/2018
CN 108183331 A 6/2018
JP 2017034668 A 2/2017
JP 3213873 U 12/2017
JP 2019022218 A 2/2019
JP 2019050561 A 3/2019
JP 2019050562 A 3/2019
JP 2019050564 A 3/2019
JP 2019050565 A 3/2019
JP 2019068412 A 4/2019
KR 10-2014-0114015 A 9/2014
KR 20180014630 A 2/2018
WO 2017065142 A1 4/2017
WO 2018026136 A1 2/2018

* cited by examiner

ELECTRONIC DEVICE ANTENNAS HAVING SWITCHABLE FEED TERMINALS

BACKGROUND

This relates to electronic devices, and more particularly, to antennas for electronic devices with wireless communications circuitry.

Electronic devices often include wireless communications circuitry. For example, cellular telephones, computers, and other devices often contain antennas and wireless transceivers for supporting wireless communications.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover many different cellular telephone communications bands at different frequencies.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies. In addition, it is often difficult to perform wireless communications with a satisfactory data rate (data throughput), especially as software applications performed by wireless devices become increasingly data hungry.

It would therefore be desirable to be able to provide improved wireless communications circuitry for wireless electronic devices.

SUMMARY

An electronic device may be provided with wireless circuitry and a housing having a peripheral conductive housing structures. The wireless circuitry may include an antenna, radio-frequency transceiver circuitry, and a radio-frequency transmission line. The transmission line may include a ground conductor and a signal conductor. The antenna may include a resonating element arm formed from a first segment of the peripheral conductive housing structures that is separated from ground structures by a slot. A dielectric-filled gap in the peripheral conductive housing structures may separate the first segment from a second segment of the peripheral conductive housing structures. A vertical portion of the slot may extend between the ground structures and the second segment.

The antenna may be fed using an antenna feed that conveys radio-frequency signals for the radio-frequency transmission line. The antenna feed may include a ground antenna feed terminal coupled to the ground structures, first and second positive antenna feed terminals coupled to the first segment, and a third positive antenna feed terminal coupled to the third segment. A conductive path may be coupled between the first and third positive antenna feed terminals. A first adjustable component may be interposed on the conductive path. The first adjustable component may have a first state in which the first segment indirectly feeds radio-frequency signals to the second segment in a cellular high band. The adjustable component may have a second state in which antenna currents are directly fed to the second segment through the third positive antenna feed terminal and in which the vertical portion of the slot radiates in the cellular high band. A second adjustable component may tune a frequency response of the antenna and may have a first terminal coupled to the signal conductor, a second terminal coupled to the first segment, and a third terminal coupled to the ground structures.

A conductive trace may be coupled between a node on the signal terminal and the second positive antenna feed terminal. The conductive trace may serve as a low-inductance feed combiner for the antenna. The conductive trace may have a width and a length that is between two and ten times the width to optimize the inductance between the signal conductor and the second positive antenna feed terminal. A switch may be interposed on the signal conductor between the node and the first positive antenna feed terminal. The first terminal of the second adjustable component may be interposed on the signal conductor between the switch and the first positive antenna feed terminal.

When the switch is in an open state, the second positive antenna feed terminal and the first segment may convey radio-frequency signals in a cellular low band. When the switch is in a closed state, the first positive antenna feed terminal and the first segment may convey radio-frequency signals in the cellular low band, a cellular low-midband, a cellular midband, and/or a cellular ultra-high band. The third antenna feed terminal and the vertical portion of the slot or the second segment may convey radio-frequency signals in the cellular high band while the switch is in the closed state.

DETAILED DESCRIPTION

Figure 1:
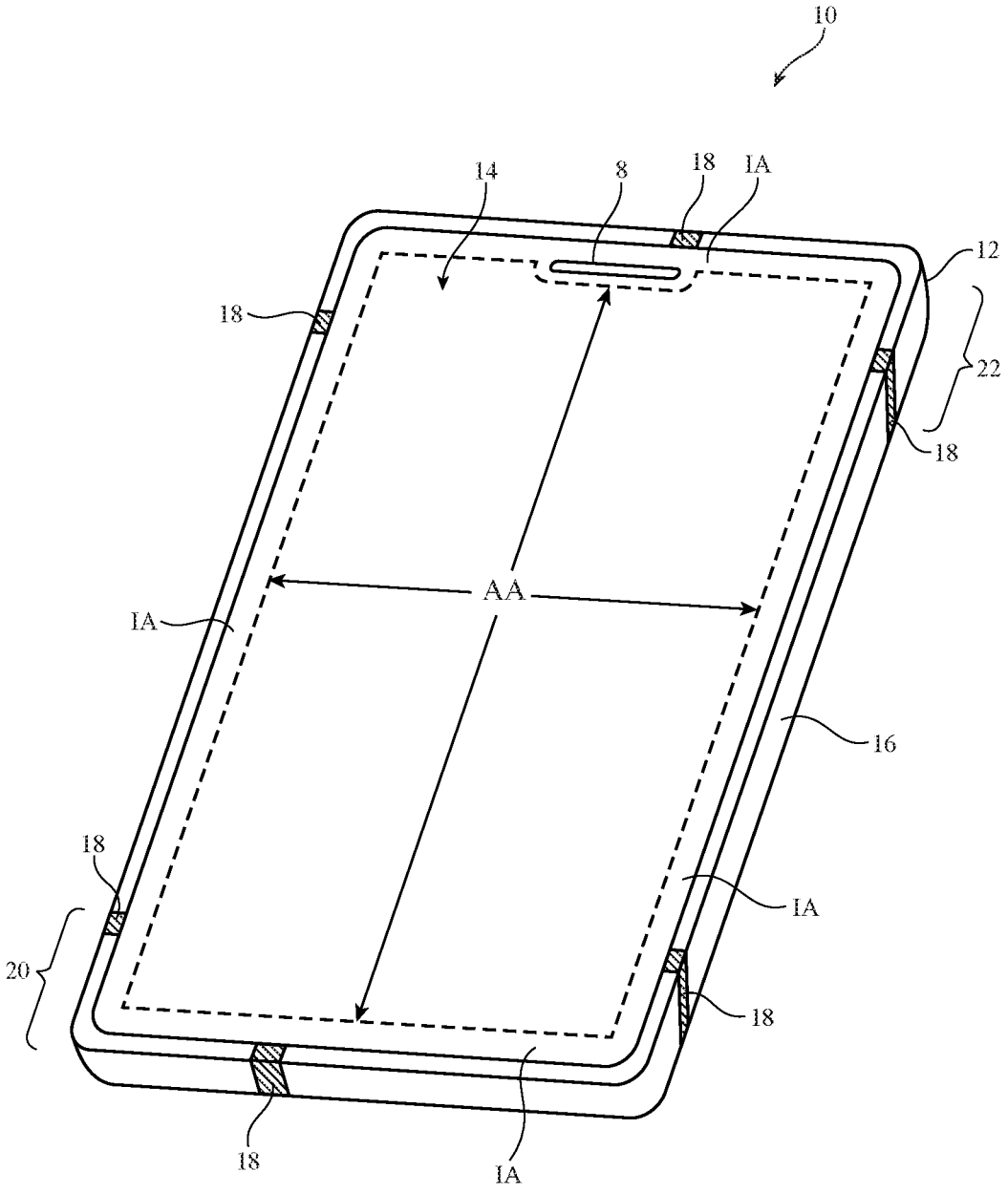
FIG. 1 is a perspective view of an illustrative electronic device in accordance with an embodiment.

Electronic devices such as electronic device 10 of FIG. 1 may be provided with wireless communications circuitry.

The wireless communications circuitry may be used to support wireless communications in multiple wireless communications bands.

The wireless communications circuitry may include one or more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a rear housing wall (e.g., a planar housing wall). The rear housing wall may have slots that pass entirely through the rear housing wall and that therefore separate housing wall portions (rear housing wall portions and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. If desired, buttons may pass through openings in the cover layer. The cover layer may also have other openings such as an opening for speaker port 8.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, peripheral conductive housing sidewall structures, peripheral conductive housing sidewalls, peripheral conductive sidewalls, or a peripheral conductive housing member (as examples). Peripheral conductive housing structures 16 may be formed from a metal such as stainless steel, aluminum, or other suitable materials. One, two, three, four, five, six, or more than six separate structures may be used in forming peripheral conductive housing structures 16.

It is not necessary for peripheral conductive housing structures 16 to have a uniform cross-section. For example, the top portion of peripheral conductive housing structures 16 may, if desired, have an inwardly protruding lip that helps hold display 14 in place. The bottom portion of peripheral conductive housing structures 16 may also have an enlarged lip (e.g., in the plane of the rear surface of device 10). Peripheral conductive housing structures 16 may have substantially straight vertical sidewalls, may have sidewalls that are curved, or may have other suitable shapes. In some configurations (e.g., when peripheral conductive housing structures 16 serve as a bezel for display 14), peripheral conductive housing structures 16 may run around the lip of housing 12 (i.e., peripheral conductive housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a conductive rear housing wall of device 10 may be formed from a planar metal structure and portions of peripheral conductive housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The conductive rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 and/or the conductive rear wall of housing 12 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of the rear wall of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 16 may be provided with peripheral gap structures. For example, peripheral conductive housing structures 16 may be provided with one or more gaps such as gaps 18, as shown in FIG. 1. The gaps in peripheral conductive housing structures 16 may be filled with dielectric such as polymer, ceramic, glass, air, other dielectric materials, or combinations of these materials. Gaps 18 may divide peripheral conductive housing structures 16 into one or more peripheral conductive segments. There may be, for example, two peripheral conductive segments in peripheral conductive housing structures 16 (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

Figure 2:
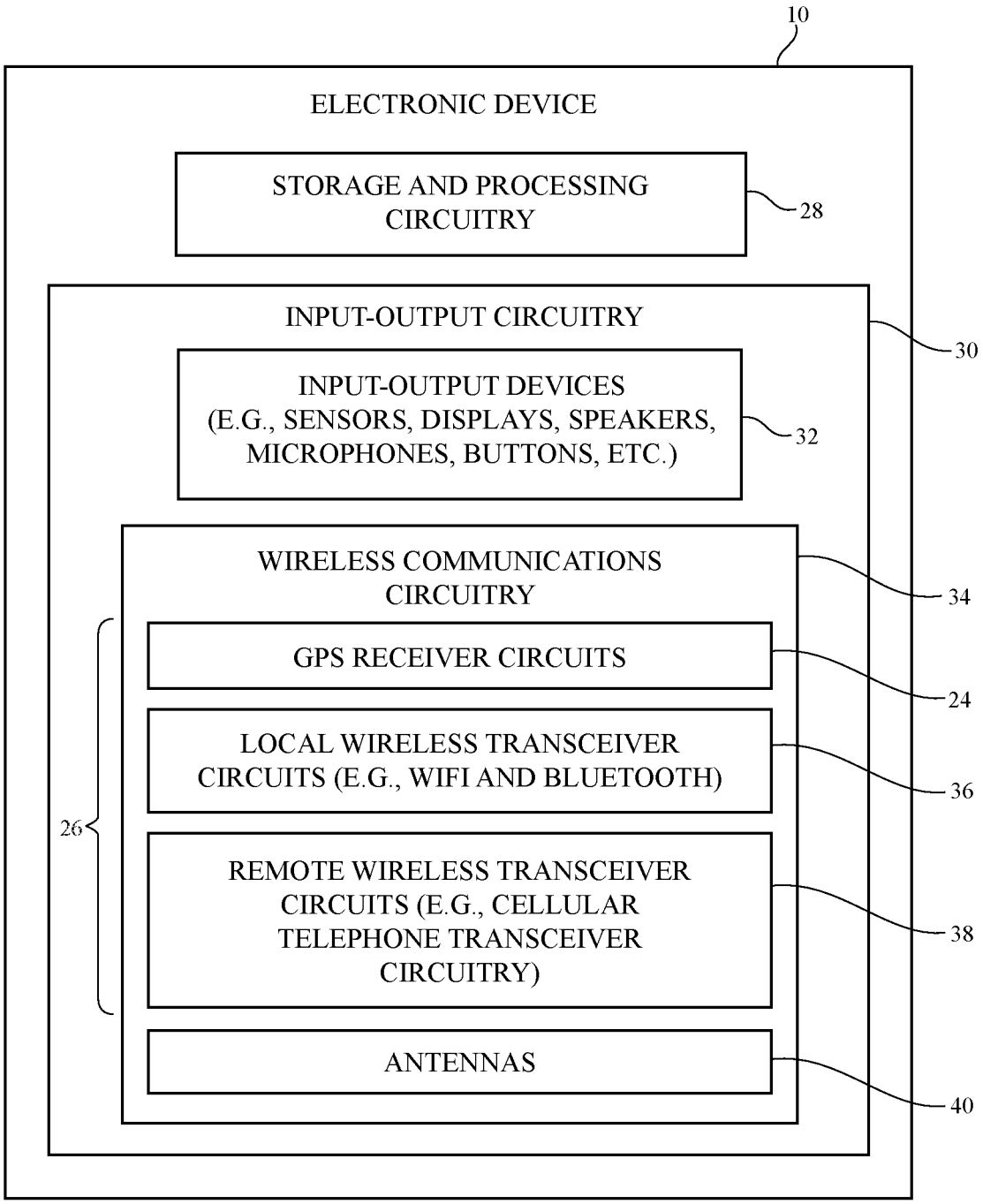
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 (sometimes referred to herein as control circuitry 28) may be used to run software on device 10, such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol, cellular telephone protocols, multiple-input and multiple-output (MIMO) protocols, antenna diversity protocols, near-field communications (NFC) protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 26 for handling various radio-frequency communications bands. For example, circuitry 34 may include transceiver circuitry 36, 38, and 24. Transceiver circuitry 36 may handle 2.4 GHz and 5 GHz bands for Wi-Fi® (IEEE 802.11) communications or communications in other wireless local area network (WLAN) bands and may handle the 2.4 GHz Bluetooth® communications band or other wireless personal area network (WPAN) bands. Circuitry 34 may use cellular telephone transceiver circuitry 38 for handling wireless communications in frequency ranges such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3400 to 3600 MHz, or other communications bands between 600 MHz and 4000 MHz or other suitable frequencies (as examples).

Circuitry 38 may handle voice data and non-voice data. Wireless communications circuitry 34 can include circuitry for other short-range and long-range wireless links if desired. For example, wireless communications circuitry 34 may include 60 GHz transceiver circuitry (e.g., millimeter wave transceiver circuitry), circuitry for receiving television and radio signals, paging system transceivers, near field communications (NFC) circuitry, etc. Wireless communications circuitry 34 may include global positioning system (GPS) receiver equipment such as GPS receiver circuitry 24 for receiving GPS signals at 1575 MHz or for handling other satellite positioning data. In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
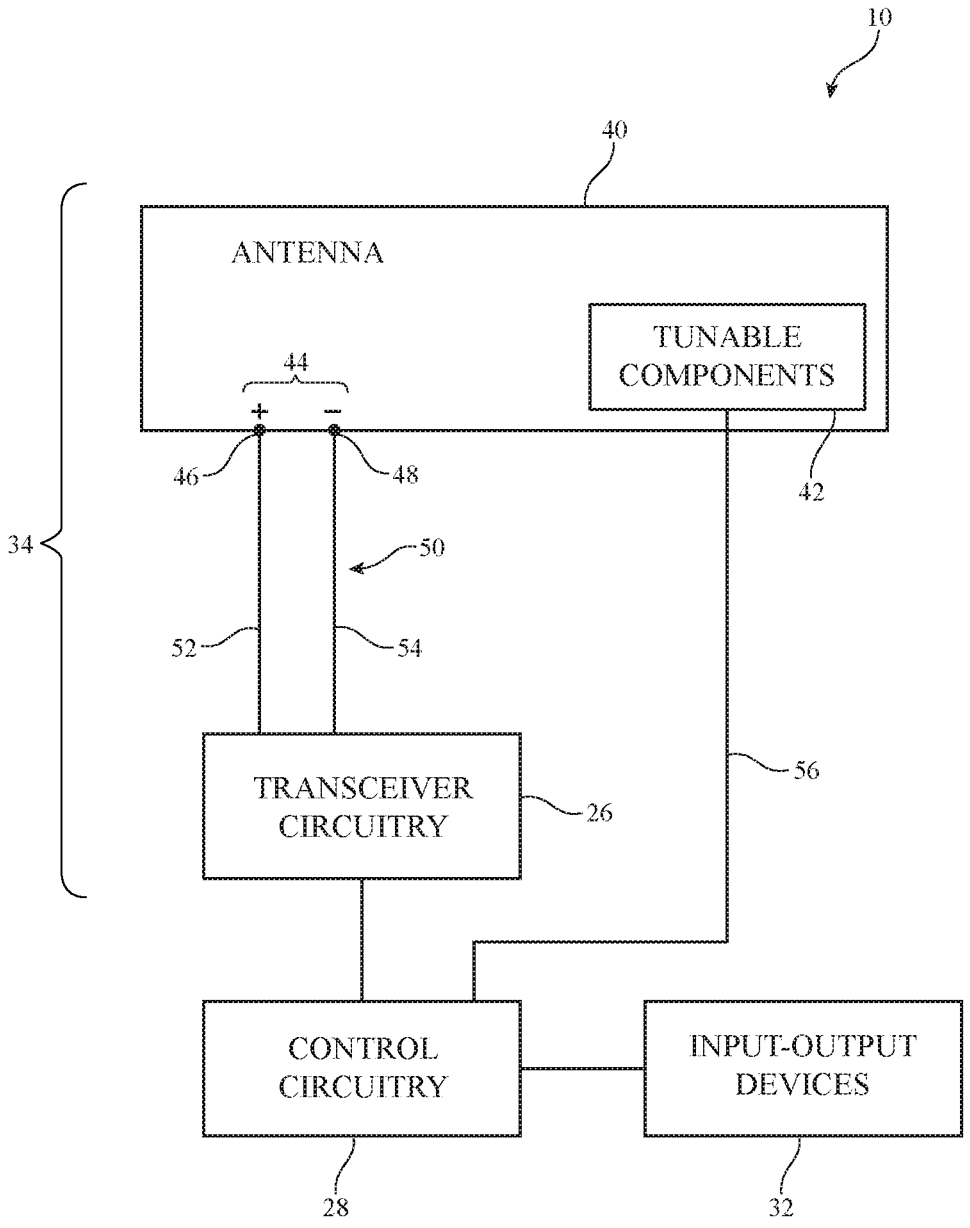
FIG. 3 is a schematic diagram of illustrative wireless communications circuitry in accordance with an embodiment.

As shown in FIG. 3, transceiver circuitry 26 in wireless communications circuitry 34 may be coupled to antenna structures such as a given antenna 40 using paths such as path 50. Wireless communications circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 42 to tune the antenna over communications bands of interest. Tunable components 42 may be part of a tunable filter or tunable impedance matching network, may be part of an antenna resonating element, may span a gap between an antenna resonating element and antenna ground, etc.

Tunable components 42 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 56 that adjust inductance values, capacitance values, or other parameters associated with tunable components 42, thereby tuning antenna 40 to cover desired communications bands. Antenna tuning components that are used to adjust the frequency response of antenna 40 such as tunable components 42 may sometimes be referred to herein as antenna tuning components, tuning components, antenna tuning elements, tuning elements, adjustable tuning components, adjustable tuning elements, or adjustable components.

Path 50 may include one or more transmission lines. As an example, path 50 of FIG. 3 may be a transmission line having a positive signal conductor such as line 52 and a ground signal conductor such as line 54. Path 50 may sometimes be referred to herein as transmission line 50 or radio-frequency transmission line 50. Line 52 may sometimes be referred to herein as positive signal conductor 52, signal conductor 52, signal line conductor 52, signal line 52, positive signal line 52, signal path 52, or positive signal path 52 of transmission line 50. Line 54 may sometimes be referred to herein as ground signal conductor 54, ground conductor 54, ground line conductor 54, ground line 54, ground signal line 54, ground path 54, or ground signal path 54 of transmission line 50.

Transmission line 50 may, for example, include a coaxial cable transmission line (e.g., ground conductor 54 may be implemented as a grounded conductive braid surrounding signal conductor 52 along its length), a stripline transmission line, a microstrip transmission line, coaxial probes realized by a metalized via, an edge-coupled microstrip transmission line, an edge-coupled stripline transmission line, a waveguide structure (e.g., a coplanar waveguide or grounded coplanar waveguide), combinations of these types of transmission lines and/or other transmission line structures, etc.

Transmission lines in device 10 such as transmission line 50 may be integrated into rigid and/or flexible printed circuit boards. In one suitable arrangement, transmission lines such as transmission line 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 42) may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 50 may be coupled to antenna feed structures associated with antenna 40. As an example, antenna 40 may form an inverted-F antenna, a slot antenna, a hybrid inverted-F slot antenna or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of transceiver circuitry 26 over a corresponding transmission line. If desired, signal conductor 52 may be coupled to multiple locations on antenna 40 (e.g., antenna 40 may include multiple positive antenna feed terminals coupled to signal conductor 52 of the same transmission line 50). Switches may be interposed on the signal conductor between transceiver circuitry 26 and the positive antenna feed terminals if desired (e.g., to selectively activate one or more positive antenna feed terminals at any given time). The illustrative feeding configuration of FIG. 3 is merely illustrative.

Control circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through speaker port 8 (FIG. 1), information from one or more antenna impedance sensors, information on desired frequency bands to use for communications, and/or other information in determining when antenna 40 is being affected by the presence of nearby external objects or is otherwise in need of tuning. In response, control circuitry 28 may adjust an adjustable inductor, adjustable capacitor, switch, or other tunable components such as tunable components 42 to ensure that antenna 40 operates as desired. Adjustments to tunable components 42 may also be made to extend the frequency coverage of antenna 40 (e.g., to cover desired communications bands that extend over a range of frequencies larger than antenna 40 would cover without tuning).

Antenna 40 may include resonating element structures (sometimes referred to herein as radiating element structures), antenna ground plane structures (sometimes referred to herein as ground plane structures, ground structures, or antenna ground structures), an antenna feed such as feed 44, and other components (e.g., tunable components 42). Antenna 40 may be configured to form any suitable types of antenna. With one suitable arrangement, which is sometimes described herein as an example, antenna 40 is used to implement a hybrid inverted-F-slot antenna that includes both inverted-F and slot antenna resonating elements.

Figure 4:
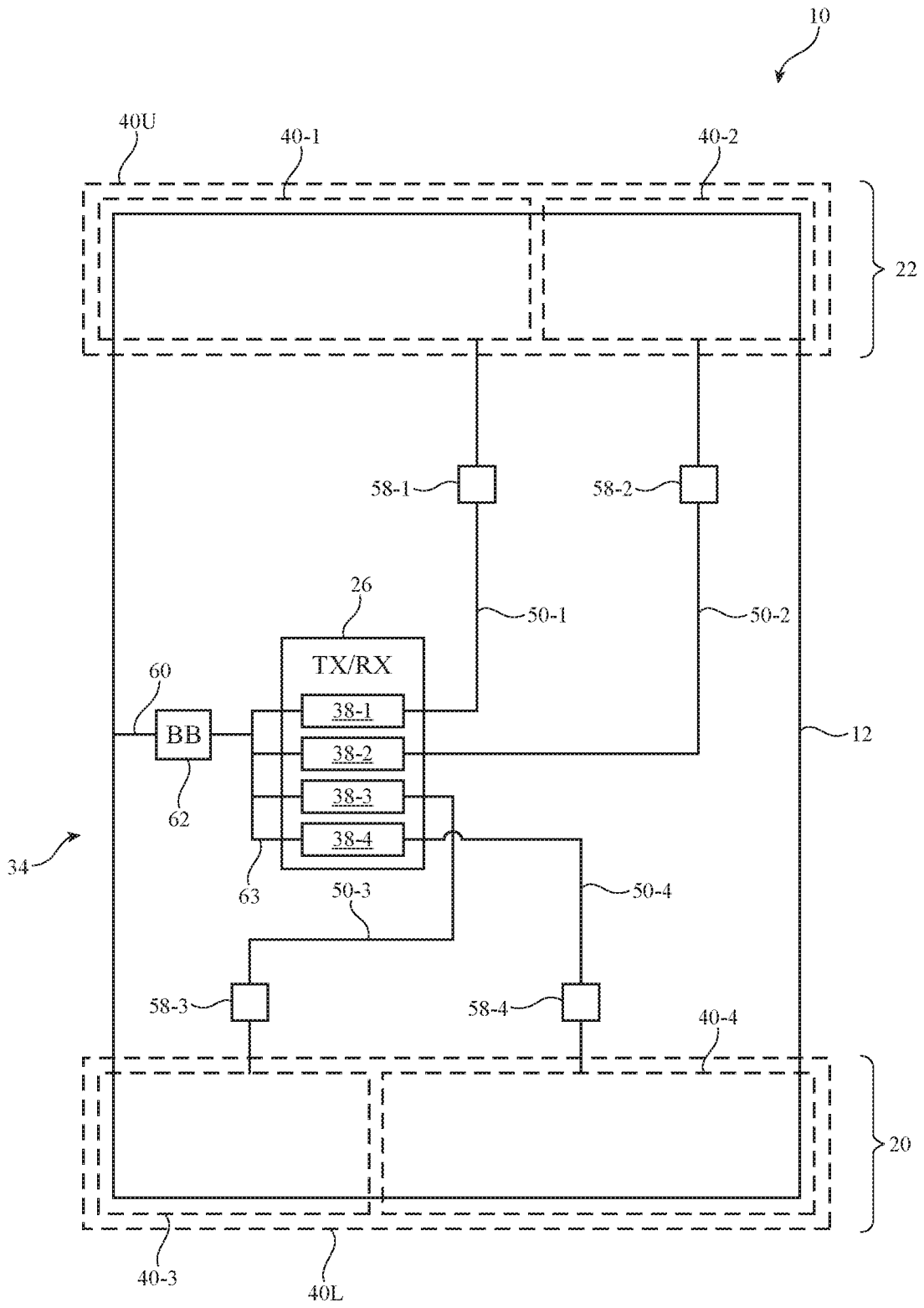
FIG. 4 is a diagram of illustrative wireless circuitry including multiple antennas for performing multiple-input and multiple-output (MIMO) communications in accordance with an embodiment.

If desired, multiple antennas 40 may be formed in device 10. Each antenna 40 may be coupled to transceiver circuitry such as transceiver circuitry 26 over respective transmission lines such as transmission line 50. If desired, two or more antennas 40 may share the same transmission line 50. FIG. 4 is a diagram showing how device 10 may include multiple antennas 40 for performing wireless communications.

As shown in FIG. 4, device 10 may include two or more antennas 40 such as a first antenna 40-1, a second antenna 40-2, a third antenna 40-3, and a fourth antenna 40-4. Antennas 40 may be provided at different locations within housing 12 of device 10. For example, antennas 40-1 and 40-2 may be formed within region 22 at a first (upper) end of housing 12 whereas antennas 40-3 and 40-4 are formed within region 20 at an opposing second (lower) end of housing 12. In the example of FIG. 3, housing 12 has a rectangular periphery (e.g., a periphery having four corners) and each antenna 40 is formed at a respective corner of housing 12. This example is merely illustrative and, in general, antennas 40 may be formed at any desired locations within housing 12.

Wireless communications circuitry 34 may include input-output ports such as port 60 for interfacing with digital data circuits in control circuitry (e.g., storage and processing circuitry 28 of FIG. 2). Wireless communications circuitry 34 may include baseband circuitry such as baseband (BB) processor 62 and radio-frequency transceiver circuitry such as transceiver circuitry 26.

Port 60 may receive digital data from control circuitry that is to be transmitted by transceiver circuitry 26. Incoming data that has been received by transceiver circuitry 26 and baseband processor 62 may be supplied to control circuitry via port 60.

Transceiver circuitry 26 may include one or more transmitters and one or more receivers. For example, transceiver circuitry 26 may include multiple remote wireless transceivers 38 such as a first transceiver 38-1, a second transceiver 38-2, a third transceiver 38-3, and a fourth transceiver 38-4 (e.g., transceiver circuits for handling voice and non-voice cellular telephone communications in cellular telephone communications bands). Each transceiver 38 may be coupled to a respective antenna 40 over a corresponding transmission line 50 (e.g., a first transmission line 50-1, a second transmission line 50-2, a third transmission line 50-3, and a fourth transmission line 50-4). For example, first transceiver 38-1 may be coupled to antenna 40-1 over transmission line 50-1, second transceiver 38-2 may be coupled to antenna 40-2 over transmission line 50-2, third transceiver 38-3 may be coupled to antenna 40-3 over transmission line 50-3, and fourth transceiver 38-4 may be coupled to antenna 40-4 over transmission line 50-4.

Radio-frequency front end circuits 58 may be interposed on each transmission line 50 (e.g., a first front end circuit 58-1 may be interposed on transmission line 50-1, a second front end circuit 58-2 may be interposed on transmission line 50-2, a third front end circuit 58-3 may be interposed on transmission line 50-3, etc.). Front end circuits 58 may each include switching circuitry, filter circuitry (e.g., duplexer and/or diplexer circuitry, notch filter circuitry, low pass filter circuitry, high pass filter circuitry, bandpass filter circuitry, etc.), impedance matching circuitry for matching the impedance of transmission lines 50 to the corresponding antenna 40, networks of active and/or passive components such as tunable components 42 of FIG. 3, radio-frequency coupler circuitry for gathering antenna impedance measurements, amplifier circuitry (e.g., low noise amplifiers and/or power amplifiers) or any other desired radio-frequency circuitry. If desired, front end circuits 58 may include switching circuitry that is configured to selectively couple antennas 40-1, 40-2, 40-3, and 40-4 to different respective transceivers 38-1, 38-2, 38-3, and 38-4 (e.g., so that each antenna can handle communications for different transceivers 38 over time based on the state of the switching circuits in front end circuits 58).

If desired, front end circuits 58 may include filtering circuitry (e.g., duplexers and/or diplexers) that allow the corresponding antenna 40 to transmit and receive radio-frequency signals at the same time (e.g., using a frequency domain duplexing (FDD) scheme). Antennas 40-1, 40-2, 40-3, and 40-4 may transmit and/or receive radio-frequency signals in respective time slots or two or more of antennas 40-1, 40-2, 40-3, and 40-4 may transmit and/or receive radio-frequency signals concurrently. In general, any desired combination of transceivers 38-1, 38-2, 38-3, and 38-4 may transmit and/or receive radio-frequency signals using the corresponding antenna 40 at a given time. In one suitable arrangement, each of transceivers 38-1, 38-2, 38-3, and 38-4 may receive radio-frequency signals while a given one of transceivers 38-1, 38-2, 38-3, and 38-4 transmits radio-frequency signals at a given time.

Amplifier circuitry such as one or more power amplifiers may be interposed on transmission lines 50 and/or formed within transceiver circuitry 26 for amplifying radio-frequency signals output by transceivers 38 prior to transmission over antennas 40. Amplifier circuitry such as one or more low noise amplifiers may be interposed on transmission lines 50 and/or formed within transceiver circuitry 26 for amplifying radio-frequency signals received by antennas 40 prior to conveying the received signals to transceivers 38.

In the example of FIG. 4, separate front end circuits 58 are formed on each transmission line 50. This is merely illustrative. If desired, two or more transmission lines 50 may share the same front end circuits 58 (e.g., front end circuits 58 may be formed on the same substrate, module, or integrated circuit).

Each of transceivers 38 may, for example, include circuitry for converting baseband signals received from baseband processor 62 over paths 63 into corresponding radio-frequency signals. For example, transceivers 38 may each include mixer circuitry for up-converting the baseband signals to radio-frequencies prior to transmission over antennas 40. Transceivers 38 may include digital to analog converter (DAC) and/or analog to digital converter (ADC) circuitry for converting signals between digital and analog domains. Each of transceivers 38 may include circuitry for converting radio-frequency signals received from antennas 40 over transmission lines 50 into corresponding baseband signals. For example, transceivers 38 may each include mixer circuitry for down-converting the radio-frequency signals to baseband frequencies prior to conveying the baseband signals to baseband processor 62 over paths 63.

Each transceiver 38 may be formed on the same substrate, integrated circuit, or module (e.g., transceiver circuitry 26 may be a transceiver module having a substrate or integrated circuit on which each of transceivers 38 are formed) or two or more transceivers 38 may be formed on separate substrates, integrated circuits, or modules. Baseband processor 62 and front end circuits 58 may be formed on the same substrate, integrated circuit, or module as transceivers 38 or may be formed on separate substrates, integrated circuits, or modules from transceivers 38. In another suitable arrangement, transceiver circuitry 26 may include a single transceiver 38 having four ports, each of which is coupled to a respective transmission line 50, if desired. Each transceiver 38 may include transmitter and receiver circuitry for both transmitting and receiving radio-frequency signals. In another suitable arrangement, one or more transceivers 38 may perform only signal transmission or signal reception (e.g., one or more of circuits 38 may be a dedicated transmitter or dedicated receiver).

In the example of FIG. 4, antennas 40-1 and 40-4 may occupy a larger space (e.g., a larger area or volume within device 10) than antennas 40-2 and 40-3. This may allow antennas 40-1 and 40-4 to support communications at longer wavelengths (i.e., lower frequencies) than antennas 40-2 and

40-3. This is merely illustrative and, if desired, each of antennas 40-1, 40-2, 40-3, and 40-4 may occupy the same volume or may occupy different volumes. Antennas 40-1, 40-2, 40-3, and 40-4 may be configured to convey radio-frequency signals in at least one common frequency band. If desired, one or more of antennas 40-1, 40-2, 40-3, and 40-4 may handle radio-frequency signals in at least one frequency band that is not covered by one or more of the other antennas in device 10.

If desired, each antenna 40 and each transceiver 38 may handle radio-frequency communications in multiple frequency bands (e.g., multiple cellular telephone communications bands). For example, transceiver 38-1, antenna 40-1, transceiver 38-4, and antenna 40-4, may handle radio-frequency signals in a first frequency band such as a cellular low band between 600 and 960 MHz, a second frequency band such as a cellular low-midband between 1410 and 1510 MHz, a third frequency band such as a cellular midband between 1700 and 2200 MHz, a fourth frequency band such as a cellular high band between 2300 and 2700 MHz, and/or a fifth frequency band such as a cellular ultra-high band between 3400 and 3600 MHz. Transceiver 38-2, antenna 40-2, transceiver 38-3, and antenna 40-3 may handle radio-frequency signals in some or all of these bands (e.g., in scenarios where the volume of antennas 40-3 and 40-2 is large enough to support frequencies in the low band).

The example of FIG. 4 is merely illustrative. In general, antennas 40 may cover any desired frequency bands. Transceiver circuitry 26 may include other transceiver circuits such as one or more circuits 36 or 24 of FIG. 2 coupled to one or more antennas 40. Housing 12 may have any desired shape. Antennas 40 may be formed at any desired locations within housing 12. Forming each of antennas 40-1 through 40-4 at different corners of housing 12 may, for example, maximize the multi-path propagation of wireless data conveyed by antennas 40 to optimize overall data throughput for wireless communications circuitry 34.

When operating using a single antenna 40, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna 40 may not be capable of providing sufficient data throughput for handling the desired device operations.

In order to increase the overall data throughput of wireless communications circuitry 34, multiple antennas 40 may be operated using a multiple-input and multiple-output (MIMO) scheme. When operating using a MIMO scheme, two or more antennas 40 on device 10 may be used to convey multiple independent streams of wireless data at the same frequency. This may significantly increase the overall data throughput between device 10 and the external communications equipment relative to scenarios where only a single antenna 40 is used. In general, the greater the number of antennas 40 that are used for conveying wireless data under the MIMO scheme, the greater the overall throughput of wireless communications circuitry 34.

In order to perform wireless communications under a MIMO scheme, antennas 40 need to convey data at the same frequencies. If desired, wireless communications circuitry 34 may perform so-called two-stream (2×) MIMO operations (sometimes referred to herein as 2× MIMO communications or communications using a 2× MIMO scheme) in which two antennas 40 are used to convey two independent streams of radio-frequency signals at the same frequency. Wireless communications circuitry 34 may perform so-called four-stream (4×) MIMO operations (sometimes referred to herein as 4× MIMO communications or communications using a 4× MIMO scheme) in which four antennas 40 are used to convey four independent streams of radio-frequency signals at the same frequency. Performing 4× MIMO operations may support higher overall data throughput than 2× MIMO operations because 4× MIMO operations involve four independent wireless data streams whereas 2× MIMO operations involve only two independent wireless data streams. If desired, antennas 40-1, 40-2, 40-3, and 40-4 may perform 2× MIMO operations in some frequency bands and may perform 4× MIMO operations in other frequency bands (e.g., depending on which bands are handled by which antennas). Antennas 40-1, 40-2, 40-3, and 40-4 may perform 2× MIMO operations in some bands concurrently with performing 4× MIMO operations in other bands, for example.

As one example, antennas 40-1 and 40-4 (and the corresponding transceivers 38-1 and 38-4) may perform 2× MIMO operations by conveying radio-frequency signals at the same frequency in a cellular low band between 600 MHz and 960 MHz. At the same time, antennas 40-1, 40-2, 40-3, and 40-4 may collectively perform 4× MIMO operations by conveying radio-frequency signals at the same frequency in a cellular midband between 1700 and 2200 MHz and/or at the same frequency in a cellular high band (HB) between 2300 and 2700 MHz (e.g., antennas 40-1 and 40-4 may perform 2× MIMO operations in the low band concurrently with performing 4× MIMO operations in the midband and/or high band). This example is merely illustrative and, in general, any desired number of antennas may be used to perform any desired MIMO operations in any desired frequency bands.

If desired, antennas 40-1 and 40-2 may include switching circuitry that is adjusted by control circuitry (e.g., control circuitry 28 of FIG. 3). Control circuitry 28 may control the switching circuitry in antennas 40-1 and 40-2 to configure antenna structures in antennas 40-1 and 40-2 to form a single antenna 40U in region 22 of device 10. Similarly, antennas 40-3 and 40-4 may include switching circuitry that is adjusted by control circuitry 28. Control circuitry 28 may control the switching circuitry in antennas 40-3 and 40-4 to form a single antenna 40L (e.g., an antenna 40L that includes antenna structures from antennas 40-3 and 40-4) in region 20 of device 10. Antenna 40U may, for example, be formed at an upper end of housing 12 and may therefore sometimes be referred to herein as upper antenna 40U. Antenna 40L may be formed at an opposing lower end of housing 12 and may therefore sometimes be referred to herein as lower antenna 40L. When antennas 40-1 and 40-2 are configured to form upper antenna 40U and antennas 40-3 and 40-4 are configured to form lower antenna 40L, wireless communications circuitry 34 may perform 2× MIMO operations using antennas 40U and 40L in any desired frequency bands. If desired, control circuitry 28 may toggle the switching circuitry over time to switch wireless communications circuitry 34 between a first mode in which antennas 40-1, 40-2, 40-3, and 40-4 perform 2× MIMO operations in any desired frequency bands and 4× MIMO operations in any desired frequency bands and a second mode in which antennas 40-1,

40-2, 40-3, and 40-4 are configured to form antennas 40U and 40L that perform 2× MIMO operations in any desired frequency bands.

If desired, wireless communications circuitry 34 may convey wireless data with multiple antennas on one or more external devices (e.g., multiple wireless base stations) in a scheme sometimes referred to as carrier aggregation. When operating using a carrier aggregation scheme, the same antenna 40 may convey radio-frequency signals with multiple antennas (e.g., antennas on different wireless base stations) at different respective frequencies (sometimes referred to herein as carrier frequencies, channels, carrier channels, or carriers). For example, antenna 40-1 may receive radio-frequency signals from a first wireless base station at a first frequency, from a second wireless base station at a second frequency, and a from a third base station at a third frequency. The received signals at different frequencies may be simultaneously processed (e.g., by transceiver 38-1) to increase the communications bandwidth of transceiver 38-1, thereby increasing the data rate of transceiver 38-1. Similarly, antennas 40-1, 40-2, 40-3, and 40-4 may perform carrier aggregation at two, three, or more than three frequencies within any desired frequency bands. This may serve to further increase the overall data throughput of wireless communications circuitry 34 relative to scenarios where no carrier aggregation is performed. For example, the data throughput of circuitry 34 may increase for each carrier frequency that is used (e.g., for each wireless base station that communicates with each of antennas 40-1, 40-2, 40-3, and 40-4).

By performing communications using both a MIMO scheme and a carrier aggregation scheme, the data throughput of wireless communications circuitry 34 may be even greater than in scenarios where either a MIMO scheme or a carrier aggregation scheme is used. The data throughput of circuitry 34 may, for example, increase for each carrier frequency that is used by antennas 40 (e.g., each carrier frequency may contribute 40 megabits per second (Mb/s) or some other throughput to the total throughput of wireless communications circuitry 34). As one example, antennas 40-1 and 40-4 may perform carrier aggregation across three frequencies within each of the cellular low band, midband, and high band and antennas 40-3 and 40-4 may perform carrier aggregation across three frequencies within each of the cellular midband and high band. At the same time, antennas 40-1 and 40-4 may perform 2× MIMO operations in the cellular low band and antennas 40-1, 40-2, 40-3, and 40-4 may perform 4× MIMO operations in one of cellular midband and the cellular high band. In this scenario, with an exemplary throughput of 40 Mb/s per carrier frequency, wireless communications circuitry 34 may exhibit a throughput of approximately 960 Mb/s. If 4× MIMO operations are performed in both the cellular midband and the cellular high band by antennas 40-1, 40-2, 40-3, and 40-4, wireless communications circuitry 34 may exhibit an even greater throughput of approximately 1200 Mb/s. In other words, the data throughput of wireless communications circuitry 34 may be increased from the 40 Mb/s associated with conveying signals at a single frequency with a single antenna to approximately 1 gigabits per second (Gb/s) by performing communications using MIMO and carrier aggregation schemes using four antennas 40-1, 40-2, 40-3, and 40-4.

These examples are merely illustrative and, if desired, carrier aggregation may be performed in fewer than three carriers per band, may be performed across different bands, or may be omitted for one or more of antennas 40-1 through 40-4. The example of FIG. 4 is merely illustrative. If desired, antennas 40 may cover any desired number of frequency bands at any desired frequencies. More than four antennas 40 or fewer than four antennas 40 may perform MIMO and/or carrier aggregation operations at non-near-field communications frequencies if desired.

Antennas 40 may include slot antenna structures, inverted-F antenna structures (e.g., planar and non-planar inverted-F antenna structures), loop antenna structures, combinations of these, or other antenna structures. An illustrative inverted-F antenna structure is shown in FIG. 5.

Figure 5:
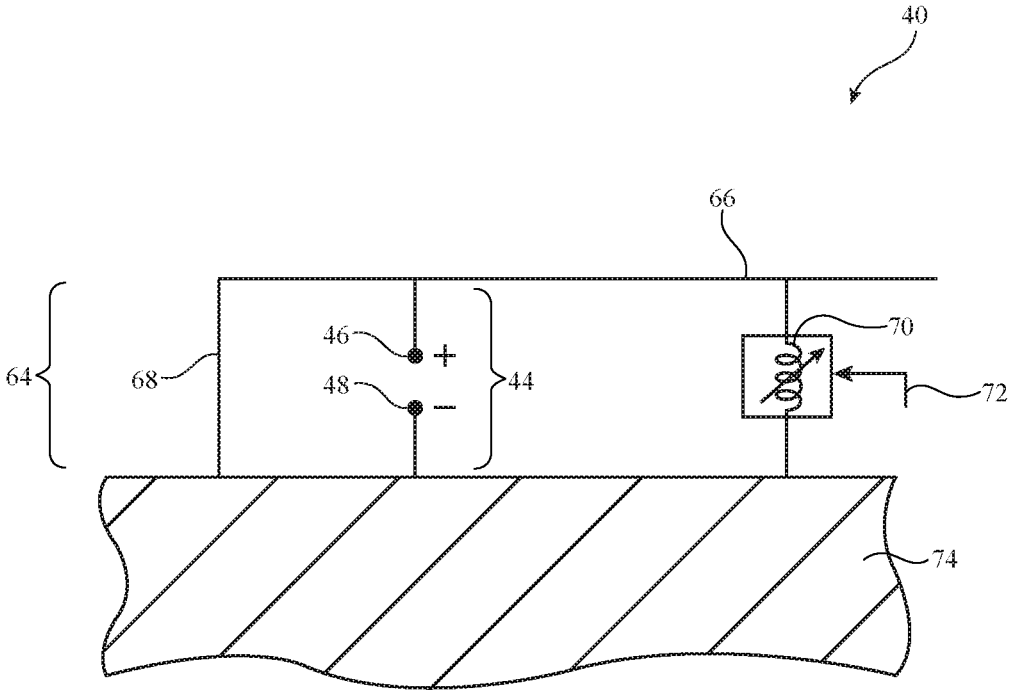
FIG. 5 is a schematic diagram of an illustrative inverted-F antenna in accordance with an embodiment.

When using an inverted-F antenna structure as shown in FIG. 5, antenna 40 may include an antenna resonating element 64 (sometimes referred to herein as antenna radiating element 64) and antenna ground 74 (sometimes referred to herein as ground plane 74 or ground 74). Antenna resonating element 64 may have a main resonating element arm such as resonating element arm 66. The length of resonating element arm 66 may be selected so that antenna 40 resonates at desired operating frequencies. For example, the length of resonating element arm 66 (or a branch of resonating element arm 66) may be approximately one-quarter of the wavelength corresponding to a desired operating frequency for antenna 40. Antenna 40 may also exhibit resonances at harmonic frequencies. If desired, slot antenna structures or other antenna structures may be incorporated into an inverted-F antenna such as antenna 40 of FIG. 5 (e.g., to enhance antenna response in one or more communications bands).

Resonating element arm 66 may be coupled to antenna ground 74 by return path 68. Antenna feed 44 may include positive antenna feed terminal 46 and ground antenna feed terminal 48 and may run parallel to return path 68 between resonating element arm 66 and antenna ground 74. If desired, antenna 40 may have more than one resonating element arm branch (e.g., to create multiple frequency resonances to support operations in multiple communications bands) or may have other antenna structures (e.g., parasitic antenna resonating elements, tunable components to support antenna tuning, etc.). For example, resonating element arm 66 may have left and right branches that extend outwardly from antenna feed 44 and return path 68. If desired, multiple feeds may be used to feed antennas such as antenna 40. Resonating element arm 66 may follow any desired path having any desired shape (e.g., curved and/or straight paths, meandering paths, etc.).

If desired, antenna 40 may include one or more adjustable circuits (e.g., tunable components 42 of FIG. 3) that are coupled to resonating element arm 66. As shown in FIG. 5, for example, tunable components such as adjustable inductor 70 may be coupled between antenna resonating element structures in antenna 40 such as resonating element arm 66 and antenna ground 74 (i.e., adjustable inductor 70 may bridge the gap between resonating element arm 66 and antenna ground 74). Adjustable inductor 70 may exhibit an inductance value that is adjusted in response to control signals 72 provided to adjustable inductor 70 from control circuitry 28 (FIG. 3).

Figure 6:
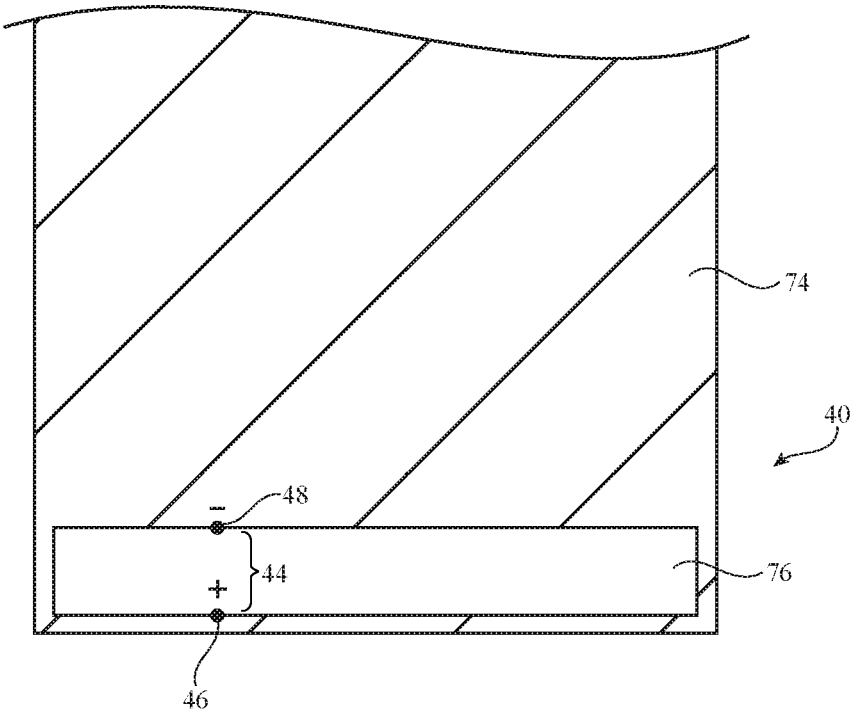
FIG. 6 is a schematic diagram of an illustrative slot antenna in accordance with an embodiment.

Antenna 40 may be a hybrid antenna that includes one or more slot elements. As shown in FIG. 6, for example, antenna 40 may be based on a slot antenna configuration having an opening such as slot 76 that is formed within conductive structures such as antenna ground 74. Slot 76 may be filled with air, plastic, and/or other dielectric. The shape of slot 76 may be straight or may have one or more bends (i.e., slot 76 may have an elongated shape following a meandering path). Feed terminals 48 and 46 may, for example, be located on opposing sides of slot 76 (e.g., on opposing long sides). Slot 76 may sometimes be referred to herein as slot element 76, slot antenna resonating element 76, slot antenna radiating element 76, or slot radiating element 76. Slot-based radiating elements such as slot 76 of FIG. 6 may give rise to an antenna resonance at frequencies in which the wavelength of the antenna signals is approximately equal to the perimeter of the slot. In narrow slots, the resonant frequency of slot 76 is associated with signal frequencies at which the slot length is approximately equal to a half of a wavelength of operation.

The frequency response of antenna 40 can be tuned using one or more tuning components (e.g., tunable components 42 of FIG. 3). These components may have terminals that are coupled to opposing sides of slot 76 (i.e., the tunable components may bridge slot 76). If desired, tunable components may have terminals that are coupled to respective locations along the length of one of the sides of slot 76. Combinations of these arrangements may also be used. If desired, antenna 40 may be a hybrid slot-inverted-F antenna that includes resonating elements of the type shown in both FIG. 5 and FIG. 6 (e.g., having resonances given by both a resonating element arm such as resonating element arm 66 of FIG. 5 and a slot such as slot 76 of FIG. 6).

The example of FIG. 6 is merely illustrative. In general, slot 76 may have any desired shape (e.g., shapes with straight and/or curved edges), may follow a meandering path, etc. If desired, slot 76 may be an open slot having one or more ends that are free from conductive material (e.g., where slot 76 extends through one or more sides of antenna ground 74). Slot 76 may, for example, have a length approximately equal to one-quarter of the wavelength of operation in these scenarios.

Figure 7:
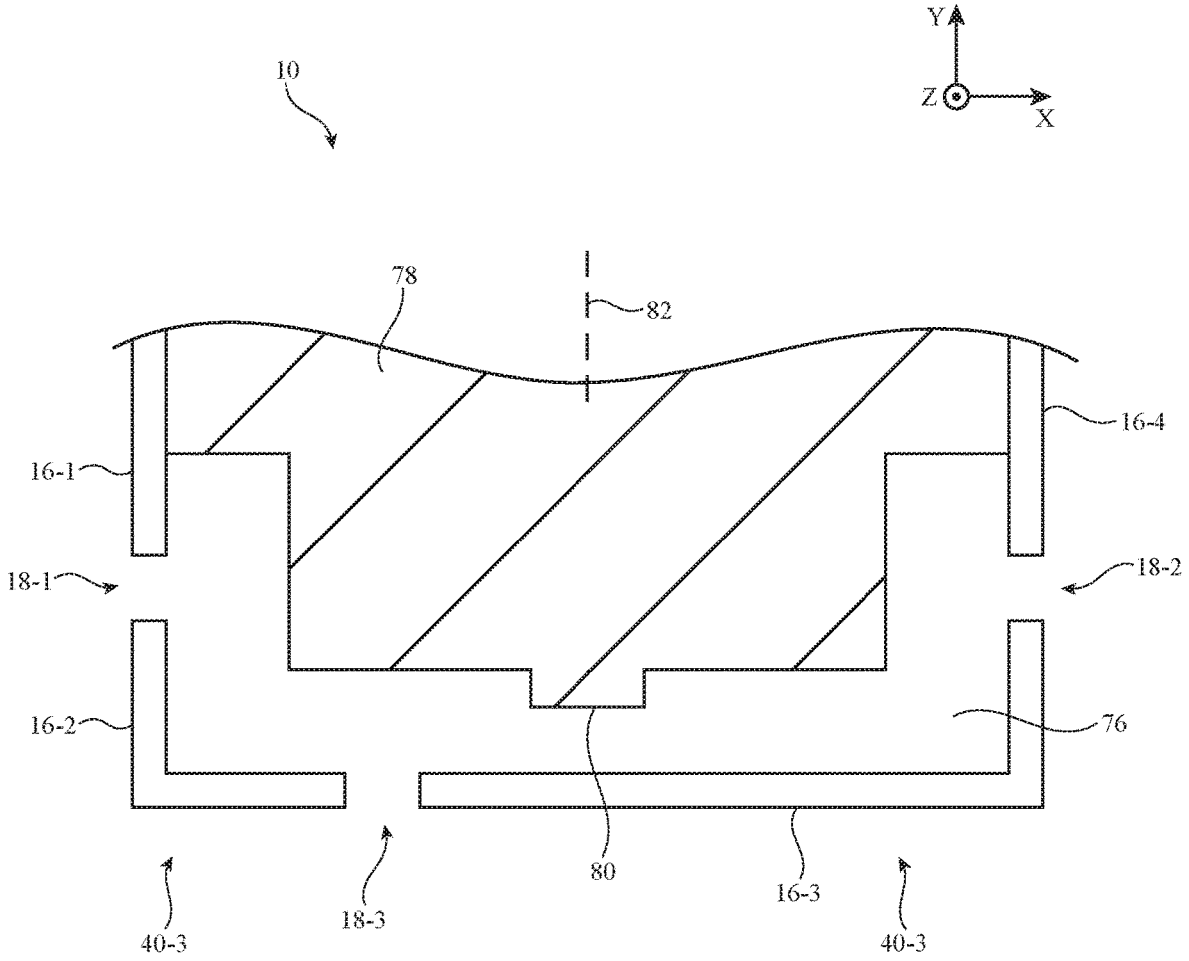
FIG. 7 is a top view of illustrative antennas formed from housing structures in an electronic device in accordance with an embodiment.

A top interior view of an illustrative portion of device 10 that contains antennas 40-4 and 40-3 of FIG. 4 is shown in FIG. 7. In the example of FIG. 7, antennas 40-3 and 40-4 are each formed using hybrid slot-inverted-F antenna structures that includes resonating elements of the types shown in FIGS. 5 and 6.

As shown in FIG. 7, peripheral conductive housing structures 16 may be segmented (divided) by dielectric-filled gaps 18 (e.g., plastic gaps) such as a first gap 18-1, a second gap 18-2, and a third gap 18-3. Each of gaps 18-1, 18-2, and 18-3 may be formed within peripheral structures 16 along respective sides of device 10. For example, gap 18-1 may be formed at a first side of device 10 and may separate a first segment 16-1 of peripheral conductive housing structures 16 from a second segment 16-2 of peripheral conductive housing structures 16. Gap 18-3 may be formed at a second side of device 10 and may separate second segment 16-2 from a third segment 16-3 of peripheral conductive housing structures 16. Gap 18-2 may be formed at a third side of device 10 and may separate third segment 16-3 from a fourth segment of peripheral conductive housing structures 16.

The resonating element for antenna 40-4 may include an inverted-F antenna resonating element arm (e.g., resonating element arm 66 of FIG. 5) that is formed from segment 16-3. The resonating element for antenna 40-3 may include an inverted-F antenna resonating element arm that is formed from segment 16-2. Air and/or other dielectric may fill slot 76 between arm segments 16-2 and 16-3 and ground structures 78.

Ground structures 78 may include one or more planar metal layers such as a metal layer used to form a rear housing wall for device 10, a metal layer that forms an internal support structure for device 10, conductive traces on a printed circuit board, and/or any other desired conductive layers in device 10. Ground structures 78 may extend from segment 16-1 to segment 16-4 of peripheral conductive housing structures 16. Ground structures 78 may be coupled to segments 16-1 and 16-4 using conductive adhesive, solder, welds, conductive screws, conductive pins, and/or any other desired conductive interconnect structures. If desired, ground structures 78 and segments 16-1 and 16-4 may be formed from different portions of a single integral conductive structure (e.g., a conductive housing for device 10).

Ground structures 78 need not be confined to a single plane and may, if desired, include multiple layers located in different planes or non-planar structures. Ground structures 78 may include conductive (e.g., grounded) portions of other electrical components within device 10. For example, ground structures 78 may include conductive portions of display 14 (FIG. 1). Conductive portions of display 14 may include a metal frame for display 14, a metal backplate for display 14, shielding layers or shielding cans for display 14, pixel circuitry in display 14, touch sensor circuitry (e.g., touch sensor electrodes) for display 14, and/or any other desired conductive structures in display 14 or used for mounting display 14 to the housing for device 10.

Ground structures 78 and segments 16-1 and 16-4 may form portions of antenna ground 74 (FIGS. 5 and 6) for antennas 40-3 and 40-40. If desired, slot 76 may be configured to form slot antenna resonating element structures that contribute to the overall performance of antennas 40-3 and/or 40-4. Slot 76 may extend from gap 18-1 to gap 18-2 (e.g., the ends of slot 76 which may sometimes be referred to as open ends, may be formed by gaps 18-1 and 18-2). Slot 76 may have an elongated shape having any suitable length (e.g., about 4-20 cm, more than 2 cm, more than 4 cm, more than 8 cm, more than 12 cm, less than 25 cm, less than 10 cm, etc.) and any suitable width (e.g., approximately 2 mm, less than 2 mm, less than 3 mm, less than 4 mm, 1-3 mm, etc.). Gap 18-3 may be continuous with and extend perpendicular to a portion of slot 76 along the longitudinal axis of the longest portion of slot 76 (e.g., the portion of slot 76 extending parallel to the X-axis of FIG. 7). If desired, slot 76 may include vertical portions that extend parallel to longitudinal axis 82 (e.g., the Y-axis of FIG. 7) and beyond gaps 18-1 and 18-2.

As shown in FIG. 7, a portion 80 of ground structures 78 may protrude into slot 76 towards segment 16-3. Portion 80 of ground structures 78 (sometimes referred to herein as protrusion 80, ground protrusion 80, extension 80, or ground extension 80) may be located closer to segment 16-3 than other portions of ground structures 78 (e.g., ground extension 80 may extend parallel to longitudinal axis 82 towards segment 16-3). Ground extension 80 may, for example, support components for display 14 of FIG. 1 (e.g., components that allow active area AA of display 14 to extend across substantially all of the front face of device 10). If desired, ground extension 80 may form a distributed capacitance with segment 16-3 that tunes the frequency response of antenna 40-4.

Slot 76 may be filled with dielectric such as air, plastic, ceramic, or glass. For example, plastic may be inserted into portions of slot 76 and this plastic may be flush with the exterior of the housing for device 10. Dielectric material in slot 76 may lie flush with dielectric material in gaps 18-1, 18-2, and 18-3 at the exterior of the housing 12 if desired. The example of FIG. 7 in which slot 76 has a U-shape is merely illustrative. If desired, slot 76 may have any other desired shapes (e.g., a rectangular shape, meandering shapes having curved and/or straight edges, etc.).

In general, it may be desirable to support multiple frequency bands using antenna 40-4 (e.g., using a MIMO scheme with the other antennas in device 10 to maximize the data rate for wireless communications circuitry 34 of FIG. 2). For example, antenna 40-4 may support communications in a cellular low band, a cellular low-midband, a cellular high band, and/or a cellular ultra-high band. In order to support operations at multiple frequency bands with satisfactory antenna efficiency, antenna 40-4 may be provided with multiple positive antenna feed terminals such as positive antenna feed terminal 46 of FIGS. 3, 5, and 6. The positive antenna feed terminals may be located at different points along segment 16-3, for example.

In some scenarios, each positive antenna feed terminal is coupled to a different respective radio-frequency transmission line (e.g., multiple radio-frequency transmission lines such as transmission line 50 of FIG. 3 may be used to feed antenna 40-4). In these scenarios, switching circuitry is used to selectively couple the transmission lines to transceiver circuitry 26 (FIG. 4) as needed. However, in practice, feeding antenna 40-4 using different transmission lines for each positive antenna feed terminal and the corresponding switching circuitry can introduce undesirable losses and attenuation to the radio-frequency signals. These losses can limit the antenna efficiency for antenna 40-4 across one or more frequency bands of interest. In addition, if care is not taken, the presence of ground extension 80 or other conductive display structures (e.g., conductive structures that maximize active area AA for display 14 of FIG. 1) can limit the antenna efficiency for antenna 40-4 at relatively low frequencies such as frequencies in a cellular low band. It would therefore be desirable to be able to provide antenna 40-4 with satisfactory antenna efficiency across each frequency band of interest.

Figure 8:
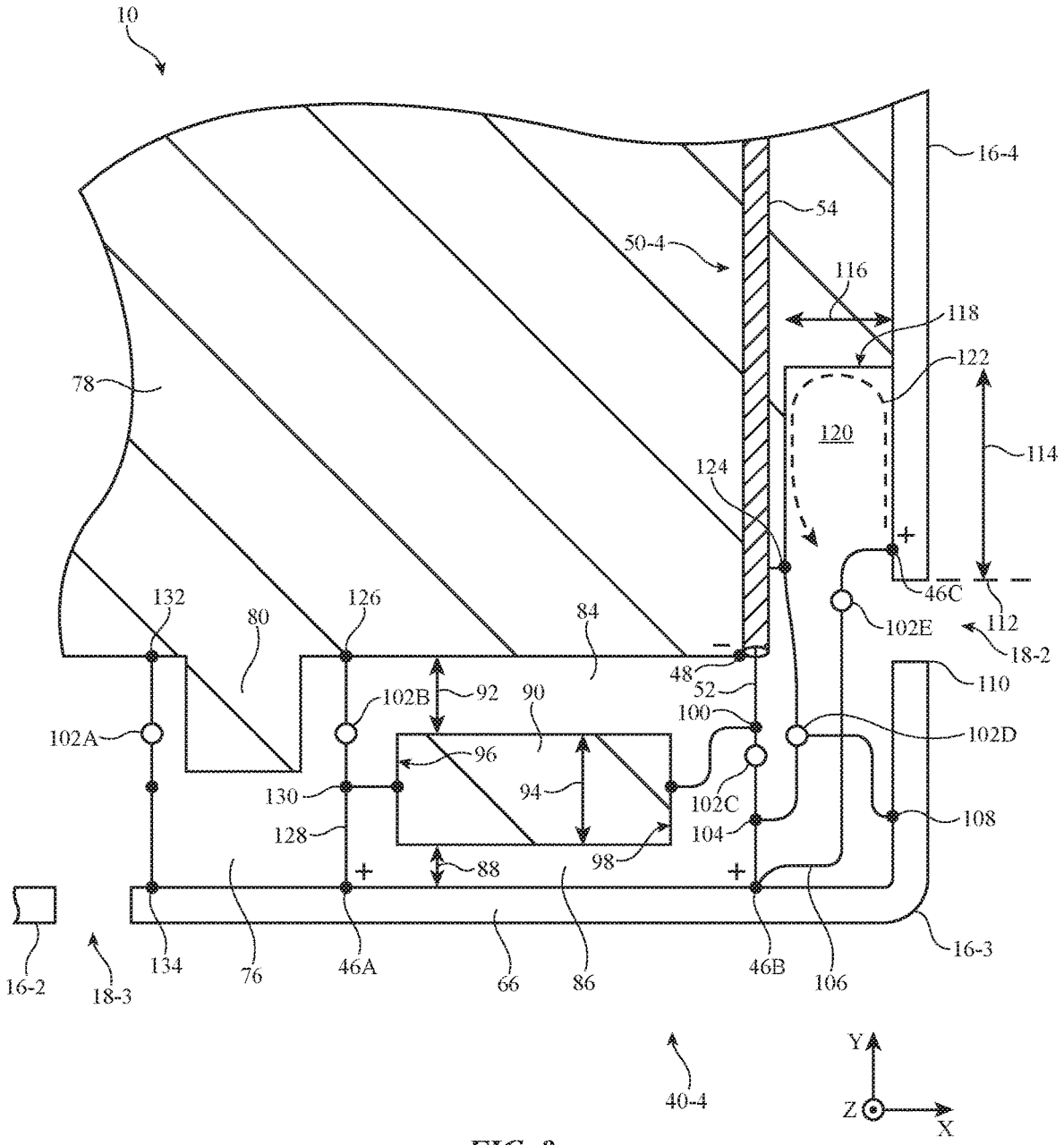
FIG. 8 is a top view of an illustrative antenna having multiple switchable signal feed terminals for optimizing radio-frequency performance across multiple different communications bands in accordance with an embodiment.

FIG. 8 is a top interior view of an illustrative portion of device 10 that contains antenna 40-4. Antenna 40-4 of FIG. 8 may, for example, support wireless communications with satisfactory antenna efficiency across multiple frequency bands of interest.

As shown in FIG. 8, antenna 40-4 may be formed at a corner of device 10 and may include an antenna resonating element arm 66 formed from segment 16-3 of peripheral conductive structures 16. Antenna 40-4 may be fed using transmission line 50-4. Transmission line 50-4 may include ground conductor 54 and signal conductor 52. In one suitable example, transmission line 50-4 is a coaxial cable having a conductive outer braid that forms ground conductor 54 and having a signal conductor 52 that is surrounded by the conductive outer braid. This is merely illustrative and, in general, any desired transmission line structures having signal conductor 52 and ground conductor 54 may be used.

Transmission line 50-4 may be coupled to an antenna feed for antenna 40-4 (e.g., antenna feed 44 of FIGS. 3, 5, and 6). The antenna feed may include ground antenna feed terminal 48 coupled to ground structures 78 at the edge of slot 76. Ground antenna feed terminal 48 may be coupled to ground conductor 54 of transmission line 50-4. The antenna feed may include multiple positive antenna feed terminals 46 coupled to peripheral conductive housing structures 16 that help to support communications across multiple frequency bands.

In the example of FIG. 8, antenna 40-4 includes a first positive antenna feed terminal 46A, a second positive antenna feed terminal 46B, and a third positive antenna feed terminal 46C. Positive antenna feed terminals 46A and 46B may be coupled to segment 16-3 of peripheral conductive housing structures 16 (e.g., antenna resonating element arm 66). Positive antenna feed terminal 46C may be coupled to segment 16-4 of peripheral conductive housing structures 16.

Ground structures 78 may have any desired shape within device 10. For example, the lower edge of ground structures 78 (e.g., the edge of ground structures 78 defining the upper edge of slot 76) may be aligned with gap 18-2 in peripheral conductive housing structures 16 (e.g., upper edge 112 or lower edge 110 of gap 18-2 may be aligned with the edge of ground structures 78 defining the portion of slot 76 adjacent to gap 18-2). If desired, as shown in the example of FIG. 8, ground structures 78 may include a slot such as vertical slot 120 adjacent to gap 18-2 that extends above upper edge 112 of gap 18-2 (e.g., in the direction of the Y-axis of FIG. 7). Vertical slot 120 may, for example, have two or more edges that are defined by ground structures 78 and one edge that is defined by segment 16-4 of peripheral conductive housing structures 16. Vertical slot 120 may have an open end defined by an open end of slot 76 at gap 18-2 and an opposing closed end 118 defined by ground structures 78. Vertical slot 120 may therefore sometimes be referred to herein as a continuous portion of slot 76, a vertical portion of slot 76, or a vertical extension of slot 76.

Vertical slot 120 may have a width 116 that separates ground structures 78 from segment 16-4 of peripheral conductive structures 16 (e.g., in the direction of the X-axis of FIG. 8). Because segment 16-4 is shorted to ground structures 78 (and thus forms part of the antenna ground for antenna 40-4), vertical slot 120 may effectively form an open slot having three sides defined by the antenna ground for antenna 40-4.

Vertical slot 120 may have any desired width 116 (e.g., about 2 mm, less than 4 mm, less than 3 mm, less than 2 mm, less than 1 mm, more than 0.5 mm, more than 1.5 mm, more than 2.5 mm, 1-3 mm, etc.). Vertical slot 120 may have an elongated length 114 (e.g., perpendicular to width 116). Length 114 may be, for example, 10-15 mm, more than 5 mm, more than 10 mm, more than 15 mm, more than 30 mm, less than 30 mm, less than 20 mm, less than 15 mm, less than 10 mm, between 5 and 20 mm, etc.

Portions of vertical slot 120 may contribute slot antenna resonances to antenna 40-4 in one or more frequency bands if desired. For example, length 114 and width 116 of vertical slot 120 (e.g., the perimeter of vertical slot 120 shown by dashed path 122) may be selected so that antenna 40-4 resonates at desired operating frequencies. If desired, the overall length of slots 76 and 120 may be selected so that antenna 40-4 resonates at desired operating frequencies.

Antenna 40-4 may include adjustable components 102 (e.g., tunable components 42 of FIG. 3) such as a first adjustable component 102A, a second adjustable component 102B, a third adjustable component 102C, a fourth adjustable component 102D, and a fifth adjustable component 102E coupled across slot 76. Return paths for antenna 40-4 such as return path 68 of FIG. 5 may be formed by adjustable components 102A, 102B, and/or 102D.

Adjustable components 102 may include switches coupled to fixed components such as inductors for providing adjustable amounts of inductance, a short circuit path, and/or an open circuit between peripheral conductive housing structures 16 and ground structures 78. If desired, adjustable components 102 may also or alternatively include fixed components that are not coupled to switches or a combination of components that are coupled to switches and components that are not coupled to switches. These examples are merely illustrative and, in general, components 102 may include other components such as adjustable return path switches, switches coupled to capacitors, or any other desired components.

In the example of FIG. 8, adjustable component 102A may bridge slot 76 at a first location along slot 76 (e.g., component 102A may be coupled between terminal 132 on ground structures 78 and terminal 134 on segment 16-3). Adjustable component 102C may be interposed on signal conductor 52.

Adjustable component 102D may bridge slot 76 and may be a three terminal component having a first terminal 104, a second terminal 108, and a third terminal 124. First terminal 104 of adjustable component 102D may be interposed on signal conductor 52 between adjustable component 102C and positive antenna feed terminal 46B. Second terminal 108 may be coupled to segment 16-3 at a location that is interposed between positive antenna feed terminal 46B and gap 18-2. Third terminal 124 may be coupled to ground structures 78. Third terminal 124 may be interposed between ground antenna feed terminal 48 and gap 18-2 on ground structures 78. If desired, third terminal 124 may be located along an edge of vertical slot 120.

Signal conductor 52 may be coupled to positive antenna feed terminal 46C over path 106. Path 106 may be coupled to positive antenna feed terminal 46B or at any other desired location between terminal 104 of adjustable component 102D and positive antenna feed terminal 46B. Adjustable component 102E may be interposed on path 106 between positive antenna feed terminal 46B and positive antenna feed terminal 46C.

Adjustable component 102B may bridge slot 76 between terminal 126 on ground structures 78 and positive antenna feed terminal 46A. Positive antenna feed terminal 46A may be interposed on segment 16-3 between terminal 134 and positive antenna feed terminal 46B. Terminal 134 may be interposed on segment 16-3 between gap 18-3 and positive antenna feed terminal 46A. Terminal 126 may be interposed on ground structures 78 between terminal 132 and ground antenna feed terminal 48. Path 128 may couple adjustable component 102B to positive antenna feed terminal 46A. A node on path 128 such as node 130 may be coupled to node 100 on signal conductor 52 through a conductive structure such as conductive trace 90. Node 100 may be interposed on signal conductor 52 between adjustable component 102C and transceiver circuitry 26 (FIG. 4).

The length of resonating element arm 66 (and the perimeter of vertical slot 120) may be selected so that antenna 40-4 radiates at desired operating frequencies such as frequencies in a cellular low band (e.g., a frequency band between about 600 MHz and 960 MHz), a cellular low-midband (e.g., a frequency band between about 1410 MHz and 1510 MHz), a cellular midband (e.g., a frequency band between about 1710 MHz and 2170 MHz), and/or a cellular ultra-high band (e.g., a frequency band between about 3400 MHz and 3600 MHz).

Positive antenna feed terminals 46A and/or 46B may be used to convey radio-frequency signals in the cellular low band as well as signals at frequencies higher than the cellular low band. For example, the length of resonating element arm 66 extending from positive antenna feed terminal 46B to gap 18-2 may be selected to cover frequencies in the cellular low-midband and/or the cellular midband. This length may be approximately equal to one-quarter of the wavelength corresponding to a frequency in the cellular midband (e.g., where the wavelength is an effective wavelength that accounts for dielectric loading by the dielectric materials in slot 76). The response of antenna 40-4 in the cellular low-midband and the cellular midband may be supported by a fundamental mode of this length. The response of antenna 40-4 in the cellular ultra-high band may be supported by a harmonic mode of this length.

Segment 16-4 of peripheral conductive housing structures 16 may contribute to the frequency response of antenna 40-4 in the cellular high band. For example, lower edge 110 of gap 18-2 (e.g., the end of resonating element arm 66 at gap 18-2) may indirectly feed segment 16-4 via near-field electromagnetic coupling (e.g., across gap 18-2). Antenna currents on resonating element arm 16-3 may induce corresponding antenna currents on segment 16-4 via the near-field electromagnetic coupling.

Length 114 may be selected to support a frequency response for antenna 40-4 in the cellular high band (e.g., length 114 may be approximately one-quarter of the effective wavelength corresponding to a frequency within the cellular high band). When segment 16-4 is indirectly fed in this way, segment 16-4 may form a parasitic antenna resonating element for antenna 40-4 (e.g., a radiating element that is not directly fed using signal conductor 52). Adjustable component 102E may be configured to form an open circuit between signal conductor 52 (positive antenna feed terminal 46B) and positive antenna feed terminal 46C when segment 16-4 is indirectly fed via near-field electromagnetic coupling.

In practice, indirectly feeding segment 16-4 may allow antenna 40-4 to cover some but not all of the cellular high band with satisfactory antenna efficiency. If desired, the frequency response of antenna 40-4 in the cellular high band may be optimized by directly feeding vertical slot 120. In order to directly feed vertical slot 120, antenna currents conveyed over signal conductor 52 may be directly fed to vertical slot 120 (e.g., over positive antenna feed terminal 46C and path 106) and may flow around the perimeter of vertical slot 120 (as shown by dashed path 122). Adjustable component 102E may be configured to form a short circuit path or another non-open-circuit impedance between signal conductor 52 (positive antenna feed terminal 46B) and positive antenna feed terminal 46C when vertical slot 120 is directly fed. In this way, path 106 may form a branch of signal conductor 52 and antenna 40-4 may be concurrently fed using both positive antenna feed terminals 46B and 46C (e.g., on opposing sides of gap 18-2).

Antenna currents flowing along path 122 may contribute a slot antenna resonance for antenna 40-4 within the cellular high band. The perimeter of vertical slot 120 (i.e., length 114, width 116, and thus the length of path 122) may be selected so that vertical slot 120 contributes a frequency response for antenna 40-4 at desired frequencies within the cellular high band. For example, the perimeter of vertical slot 120 (e.g., the length of path 122) may be approximately one-half of the effective wavelength corresponding to a frequency within the cellular high band.

Directly feeding vertical slot 120 in this way may optimize the frequency response of antenna 40-4 in the cellular high band relative to scenarios where segment 16-4 is only indirectly fed by the end of resonating element arm 66 (e.g., because vertical slot 120 offers a greater antenna area/aperture for covering the cellular high band than segment 16-4). For example, directly feeding vertical slot 120 may pull the overall frequency response of antenna 40-4 to higher frequencies within the cellular high band and may increase the overall antenna efficiency of antenna 40-4 within the cellular high band than when segment 16-4 is only indirectly fed.

The state of tuning component 102E may be toggled to adjust the frequency response of antenna 40-4 within the cellular high band (e.g., by toggling antenna 40-4 between directly feeding vertical slot 120 and indirectly feeding segment 16-4). However, if care is not taken, directly feeding vertical slot 120 in this way may deteriorate the frequency response of antenna 40-4 at other frequencies such as in the cellular low-midband.

Adjustable component 102D may be adjusted to tune the frequency response of antenna 40-4 within the cellular low-midband and/or the cellular midband (e.g., when positive antenna feed terminals 46B and 46C are active). As one example, adjustable component 102D may have first, second, and third tuning states. In the first tuning state, adjustable component 102D may form a return path (e.g., return path 68 of FIG. 5) between terminal 108 on segment 16-3 and terminal 124 on ground structures 78. In the first tuning state, an open circuit may be formed between terminal 104 and terminal 124 as well as between terminal 104 and terminal 108. In the second tuning state, a capacitance may be interposed between terminal 104 and terminal 124. In the third tuning state, an inductance may be interposed between terminal 104 and terminal 124. In the second and third tuning states, an open circuit may be formed between terminal 108 and terminal 104 as well as between terminal 108 and terminal 124. Adjustable component 102D may be placed in a selected one of the first, second, and third tuning states to tune the frequency response of antenna 40-4 within the cellular low-midband and/or the cellular midband (e.g., to compensate for potential deterioration in antenna efficiency at these frequencies when vertical slot 120 is directly fed).

When positive antenna feed terminal 46A and/or 46B is active, the length of resonating element arm 66 between positive antenna feed terminal 46A and gap 18-2, and/or between positive antenna feed terminal 46B and gap 18-3 may handle relatively low frequencies such as frequencies in the cellular low band. For example, this length may be selected to be approximately equal to one-quarter of the effective wavelength corresponding to a frequency in the cellular low band. Adjustable components 102A and/or 102B may be adjusted to tune the frequency response of antenna 40-4 in the cellular low band. For example, adjustable components 102A and 102B may include one or more inductors, capacitors, and/or resistors that are selectively switched into or out of use to tune the frequency response of antenna 40-4 in the cellular low band.

Feeding antenna 40-4 using positive antenna feed terminal 46B may limit the length of resonating element arm 66 that is available to cover the cellular low band. In addition, operations at relatively low frequencies such as frequencies in the cellular low band may be particularly susceptible to loading by ground structures 78 and external objects such as a user's hand or body. In scenarios where the length of resonating element arm 66 extending from positive antenna feed terminal 46B to gap 18-3 is used to support communications in the cellular low band, ground extension 80 and other structures associated with display 14 (FIG. 1) may undesirably load resonating element arm 66 in the cellular low band. This may limit antenna efficiency at frequencies in the cellular low band. Such undesirable loading may be mitigated by using portions of resonating element arm 66 that are located farther from ground extension 80 and gap 18-3 to cover the cellular low band.

In order to optimize performance within the cellular low band, positive antenna feed terminal 46A may be used while positive antenna feed terminals 46B and 46C are inactive (disabled). Adjustable component 102C may have a first state at which an open circuit is formed between node 100 and terminal 104 of adjustable component 102D and may have a second state at which node 100 is shorted to terminal 104. Adjustable component 102C may be placed in the first state to activate (enable) positive antenna feed terminal 46A while deactivating (disabling) positive antenna feed terminals 46B and 46C.

The length of resonating element arm 66 extending from terminal 134 to gap 18-2 may be selected to cover frequencies in the cellular low band. For example, this length may be selected to be approximately equal to one-quarter of the effective wavelength corresponding to a frequency in the cellular low band. Activating positive antenna feed terminal 46A while deactivating positive antenna feed terminals 46B and 46C may serve to shift electromagnetic hotspots in the cellular low band away from gap 18-3 and ground extension 80 and towards gap 18-2. This may serve to minimize loading in the cellular low-band by ground extension 80 and other conductive portions of display 14 of FIG. 1, as well as by external objects such as the user's body, thereby maximizing antenna efficiency in the cellular low band. When positive antenna feed terminal 46A is active and positive antenna feed terminals 46B and 46C are inactive, adjustable components 102A and/or 102B may be adjusted to tune the frequency response of antenna 40-4 in the cellular low band.

In some scenarios, positive antenna feed terminal 46A is fed using a dedicated transmission line other than transmission line 50-4. Switching circuitry is used to selectively couple each transmission line to transceiver circuitry 26 (FIG. 4). However, use of a separate transmission line and the corresponding switching circuitry can undesirably attenuate the radio-frequency signals conveyed by positive antenna feed terminal 46A. This attenuation may be eliminated by using the same radio-frequency transmission line 50-4 to convey signals to each of positive antenna feed terminals 46A, 46B, and 46C. At the same time, positive antenna feed terminal 46A is located relatively far from transmission line 50-4. If care is not taken, the relatively long conductive path length from signal conductor 52 to positive antenna feed terminal 46A may introduce excessive inductance between signal conductor 52 and positive antenna feed terminal 46A. This inductance may undesirably limit the antenna efficiency for antenna 40-4 in the cellular low band when positive antenna feed terminal 46A is active.

Conductive trace 90 may be configured to minimize the inductance associated with the relatively long conductive path length between signal conductor 52 and positive antenna feed terminal 46A. Conductive trace 90 may have a first end 98 coupled to node 100 on signal conductor 52 and an opposing second end 96 coupled to node 130 on path 128. Node 130 may be interposed on path 128 between adjustable component 102B and positive antenna feed terminal 46A. Conductive trace 90 may have a length (e.g., a longest rectangular dimension or longitudinal axis) that extends from end 96 to end 98. Conductive trace 90 may have a width 94 (e.g., a shortest rectangular dimension or dimension perpendicular to the longitudinal axis).

In order minimize the inductance between positive antenna feed terminal 46A and signal conductor 52, conductive trace 90 may have a relatively large width 94. In general, larger (wider) widths 94 may reduce the inductance between signal conductor 52 and positive antenna feed terminal 46A more than shorter (narrower) widths 94. At the same time, width 94 may be limited by the amount of space available between ground structures 78 and segment 16-3

(e.g., the width of slot 76). As examples, width 94 may be between 2.0 mm and 2.3 mm, between 2.5 mm and 2.9 mm, approximately 2.7 mm, between 1 mm and 4 mm, or any other desired width that balances a reduction in inductance with the amount of available space within slot 76. The length of conductive trace 90 (e.g., as measured perpendicular to width 94 or from end 96 to end 98) may be approximately 20 mm, between 15 mm and 25 mm, between 10 mm and 20 mm, or any other desired length. The ratio of the length of conductive trace 90 to width 94 may be between 3 and 10, between 2 and 10, between 5 and 15, between 6 and 10, between 5 and 9, or any other desired ratio, as examples.

Conductive trace 90 may be located at a distance 88 from segment 16-3 and at a distance 92 from ground structures 78 (e.g., conductive trace 90 may be separated from ground structures 78 by portion 84 of slot 76 and may be separated from segment 16-3 by portion 86 of slot 76). Distance 88 (e.g., the width of portion 86 of slot 76) may be shorter than distance 92 (e.g., the width of portion 84 of slot 76). Distance 88 may be selected to allow conductive trace 90 to form a distributed capacitance with segment 16-3 such that when positive antenna feed terminal 46B is active (e.g., when node 100 is shorted to terminal 104 of adjustable component 102D), conductive trace 90 electrically forms a single integral conductor with segment 16-3. When positive antenna feed terminal 46B is inactive (e.g., when adjustable component 102C forms an open circuit between node 100 and terminal 104 of adjustable component 102D), conductive trace 90 electrically forms an inductor that is coupled in series between node 100 and node 130 and that has an inductance that is lower than in scenarios where a conductive line or wire is used to connect node 100 to node 130. As examples, distance 92 may be approximately 1.0 mm, between 0.8 mm and 1.2 mm, between 0.6 and 1.4 mm, or any other desired distance. Distance 88 may be approximately 0.5 mm, between 0.3 mm and 0.7 mm, between 0.2 mm and 0.8 mm, between 0.6 mm and 0.1 mm, or any other desired distance that is less than distance 92.

Conductive trace 90 may be formed on the dielectric material that is used to fill slot 76 (e.g., dielectric material that forms part of the exterior of device 10) or may be formed on a dielectric substrate mounted within slot 76 (e.g., a plastic block, flexible printed circuit, rigid printed circuit board, dielectric portions of other device components, etc.). Conductive trace 90 may be formed using other conductive structures such as stamped sheet metal, metal foil, integral portions of the housing for device 10, and/or any other desired conductive structures. The example of FIG. 8 is merely illustrative. If desired, conductive trace 90 may have other shapes (e.g., shapes following straight or meandering paths and having curved and/or straight edges). Fewer or additional adjustable components 102 may be coupled between any desired locations on antenna 40-4.

When configured in this way, conductive trace 90 may form a relatively low-inductance feed line combiner that allows positive antenna feed terminals 46A and 46B to share the same signal conductor 52 without sacrificing antenna efficiency even though the terminals are located relatively far apart. Conductive trace 90 may sometimes be referred to herein as feed combiner trace 90, low inductance trace 90, low inductance feed combiner trace 90, low inductance feed line combiner trace 90, fat trace 90, thick trace 90, wide trace 90, low inductance path 90, low inductance feed combiner structure 90, or feed line inductance limiting structure 90.

Adjustable components 102A-102E may overlap slot 76. If desired, adjustable components 102A-102E may be formed on one or more printed circuits such as a flexible printed circuit board that is coupled between peripheral conductive housing structures 16 and ground structures 78. Ground structures 78 may include conductive portions of display 14 (FIG. 1), a conductive housing layer for device 10, and/or other conductive layers. If desired, conductive structures such as vertical conductive interconnect structures (e.g., brackets, clips, springs, pins, screws, solder, welds, conductive adhesive, wires, metal strips, etc.) may be used to short conductive portions of display 14 (FIG. 1) to the conductive housing layer and/or other portions of ground structures 78 (e.g., at the locations of terminals 132, 126, 48, and/or 124). Electrically connecting different components in ground structures 78 using vertical conductive interconnect structures may ensure that the conductive structures that are located the closest to resonating element arm 66 are held at a ground potential and form a part of the antenna ground for antenna 40-4. This may serve to optimize the antenna efficiency of antenna 40-4, for example. Conductive interconnect structures such as brackets, clips, springs, pins, screws, solders, welds, conductive adhesive, etc. may be used to couple terminals 134, 46A, 46B, 108, and/or 46C to peripheral conductive housing structures 16. While the example of FIG. 8 shows antenna structures for implementing antenna 40-4 in device 10, these structures may be used to implement any one of antennas 40-1, 40-2, 40-3, or 40-4 of device 10 (FIG. 4) and/or may be used to implement any desired antennas 40 in device 10.

If desired, control circuitry 28 (FIG. 3) may control adjustable components 102 to place antenna 40-4 in one of first or second operating modes (states). In the first operating mode, control circuitry 28 controls adjustable component 102C to couple node 100 to terminal 104 of adjustable component 102D so that positive antenna feed terminal 46B is active. Conductive trace 90 and segment 16-3 may electrically form a single integral conductor. This may effectively render positive antenna feed terminal 46A inactive (e.g., antenna current will not flow into segment 16-3 from positive antenna feed terminal 46A).

In the first operating mode, the length of resonating element arm 66 between positive antenna feed terminal 46B and gap 18-2 may exhibit a fundamental mode that supports communications in the cellular midband and the cellular low-midband. This length may exhibit harmonic modes that support communications in the cellular ultra-high band. The length of resonating element arm 66 between positive antenna feed terminal 46B and gap 18-3 may support communications in the cellular low band.

In the first operating mode, control circuitry 28 may control adjustable component 102E to form an open circuit so that resonating element arm 66 indirectly feeds segment 16-4 to cover the cellular high band. This may effectively deactivate positive antenna feed terminal 46C. If desired, control circuitry 28 may control adjustable component 102E to couple signal conductor 52 to positive antenna feed terminal 46C. This may effectively activate positive antenna feed terminal 46C so that vertical slot 120 is directly fed for covering the cellular high band (e.g., at higher frequencies than when adjustable component 102E forms an open circuit). Control circuitry 28 may control adjustable component 102E to adjust the inductance between signal conductor 52 and positive antenna feed terminal 46C to further tweak the frequency response of antenna 40-4 if desired.

In the second operating mode, control circuitry 28 controls adjustable component 102C to form an open circuit between node 100 and terminal 104 of adjustable component 102D. This effectively activates positive antenna feed terminal 46A (e.g., antenna current flows into segment 16-3 through conductive trace 90 and positive antenna feed terminal 46A) and deactivates positive antenna feed terminals 46B and 46C (e.g., antenna current does not flow into segment 16-3 through positive antenna feed terminal 46B or into segment 16-4 through positive antenna feed terminal 46C).

Control circuitry 28 (FIG. 3) may place antenna 40-4 into the first or second operating modes based on the needs and/or operating environment of device 10. For example, control circuitry 28 may place antenna 40-4 in the second operating mode (sometimes referred to herein as a low band operating mode) when antenna 40-4 is assigned a frequency in the cellular low band or when communications in the cellular low band is otherwise prioritized over communications in other bands (e.g., by software running on device 10 or by external equipment such as a cellular base station). Similarly, control circuitry 28 may place antenna 40-4 in the first operating mode (sometimes referred to herein as a multi-band operating mode or a high band operating mode) when antenna 40-4 is assigned a frequency outside of the cellular low band. Control circuitry 28 may adjust the state of adjustable components 102A and/or 102B to tune the frequency response in the cellular low band in either of the first or second operating modes. Control circuitry 28 may adjust the state of adjustable components 102D and/or 102E to tune the frequency response in the cellular low-midband, the cellular midband, the cellular high band, and/or the cellular ultra-high band in the first operating mode.

FIGS. 9A-9D are circuit diagrams of illustrative circuits that may be used to form any of the adjustable components 102 of FIG. 8.

Figure 9A:
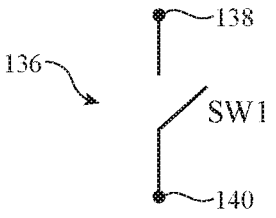
FIGS. 9A-9D are circuit diagrams of illustrative adjustable components that may be formed in an antenna of the type shown in FIG. 8 in accordance with an embodiment.

As shown in FIG. 9A, adjustable component 136 may include a switch SW1 coupled in series between terminals 138 and 140. Switch SW1 may be, for example, a single-pole single-throw (SPST) switch. When switch SW1 is placed in an open (off) state, an open circuit is formed between terminals 138 and 140. When switch SW1 is placed in a closed (on) state, a short circuit path is formed between terminals 138 and 140. If desired, one or more resistors, capacitors, and/or inductors may be coupled in series between terminals 138 and 140.

In one suitable arrangement, adjustable component 136 may be used to form adjustable component 102C of FIG. 8 (e.g., terminal 138 may be coupled to node 100 of FIG. 8 whereas terminal 140 is coupled to terminal 104 of FIG. 8). If desired, adjustable component 136 may also be used to form adjustable component 102E of FIG. 8 (e.g., terminal 140 may be coupled to positive antenna feed terminal 46B of FIG. 8 whereas terminal 138 is coupled to positive antenna feed terminal 46C of FIG. 8).

Figure 9B:
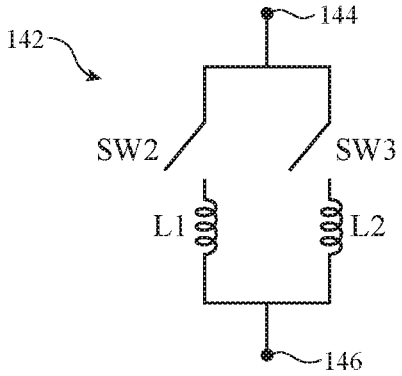

As shown in FIG. 9B, adjustable component 142 includes multiple inductors that are used in providing antenna 40-4 with an adjustable amount of inductance (e.g., component 142 may sometimes be referred to as an adjustable inductor or adjustable inductor circuitry). Control circuitry 28 (FIG. 3) may adjust circuitry 142 of FIG. 9B to produce different amounts of inductance between terminal 144 and terminal 146 by controlling the state of switching circuitry such as switches SW2 and SW3. Switches SW2 and SW3 may be implemented as two SPST switches, as one single-pole double-throw (SP2T) switch, or using any other desired circuitry.

For example, control signals may be used to switch inductor L1 into use between terminals 144 and 146 while switching inductor L2 out of use, may be used to switch inductor L2 into use between terminals 144 and 146 while switching inductor L1 out of use, may be used to switch both inductors L1 and L2 into use in parallel between terminals 144 and 146, or may be used to switch both inductors L1 and L2 out of use. The switching circuitry arrangement of FIG. 9B is therefore able to produce one or more different inductance values, two or more different inductance values, three or more different inductance values, or, if desired, four different inductance values (e.g., L1, L2, L1 and L2 in parallel, or infinite inductance when L1 and L2 are switched out of use simultaneously).

In one suitable arrangement, adjustable component 142 may be used to form adjustable component 102B of FIG. 8 (e.g., terminal 146 may be coupled to node 130 of FIG. 8 whereas terminal 144 is coupled to terminal 126 of FIG. 8). In this scenario, the inductance of adjustable component 142 can be toggled to tune the cellular low band response of antenna 40-4. If desired, adjustable component 142 may be used to form adjustable component 102E of FIG. 8 (e.g., terminal 144 may be coupled to positive antenna feed terminal 46B of FIG. 8 whereas terminal 146 is coupled to positive antenna feed terminal 46C of FIG. 8). In this scenario, the inductance of adjustable component 142 can be toggled to tune the cellular high band response of antenna 40-4.

Figure 9C:
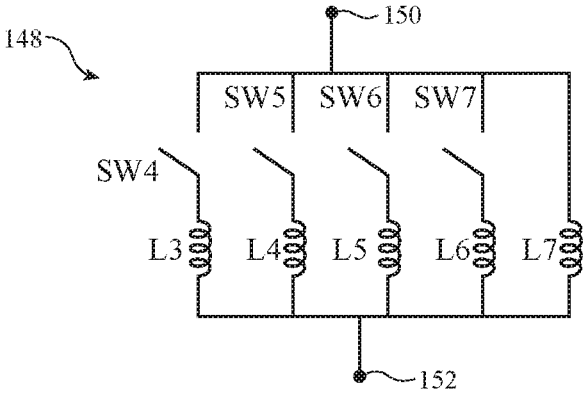

As shown in FIG. 9C, adjustable component 148 may include an inductor L3 coupled in series with switch SW4, an inductor L4 coupled in series with switch SW5, an inductor L5 coupled in series with switch SW6, an inductor L6 coupled in series with switch SW7, and an inductor L7 coupled in parallel between terminal 150 and terminal 152. Inductors L3-L7 may be used in providing antenna 40-4 with an adjustable amount of inductance. Control circuitry 28 may adjust component 148 to produce different amounts of inductance between terminal 150 and terminal 152 by controlling the state of the switches in component 148. Each of the switches may be, for example, a single-pole single-throw (SPST) switch, the switches may be implemented using a single-pole four-throw (SP4T) switch, or any other desired switching circuitry may be used.

In one suitable arrangement, adjustable component 148 may be used to form adjustable component 102A of FIG. 8 (e.g., terminal 150 may be coupled to terminal 132 of FIG. 8 whereas terminal 152 is coupled to terminal 134 of FIG. 8). In this scenario, the inductance of adjustable component 148 can be toggled to tune the cellular low band response of antenna 40-4.

Figure 9D:
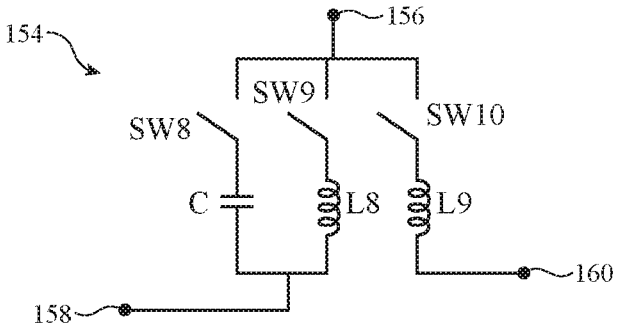

As shown in FIG. 9D, adjustable component 154 may be a three-terminal component having terminals 158, 156, and 160. Adjustable component 154 may include an inductor L8 coupled in series with switch SW9 and a capacitor C coupled in series with switch SW8 in parallel between terminals 158 and 156. Adjustable component 154 may include an inductor L9 coupled in series between terminals 160 and 156. Control circuitry 28 may adjust component 154 to close zero, one, or more than one of switches SW8, SW9, and SW10 at any given time to adjust the impedance between terminals 158, 156, and 160.

In one suitable arrangement, adjustable component 154 may be used to form adjustable component 102D of FIG. 8 (e.g., terminal 158 may be coupled to terminal 104 of FIG. 8, terminal 160 may be coupled to terminal 108 of FIG. 8, and terminal 156 may be coupled to terminal 124 of FIG. 8). In this scenario, control circuitry 28 may adjust component 154 to tune the frequency response of antenna 40-4 in the cellular low-midband, the cellular midband, the cellular high band, and/or the cellular ultra-high band (e.g., while antenna 40-4 is in the first mode of operation in which positive antenna feed terminal 46B is active).

The examples of FIGS. 9A-9D are merely illustrative. In general, adjustable components 136, 142, 148, and 154 may each include any desired number of inductive, capacitive, resistive, and switching elements arranged in any desired manner (e.g., in series, in parallel, in shunt configurations, etc.). These components may be used to form any of adjustable components 102A, 102B, 102C, 102D, or 102E of FIG. 8.

Figure 10:
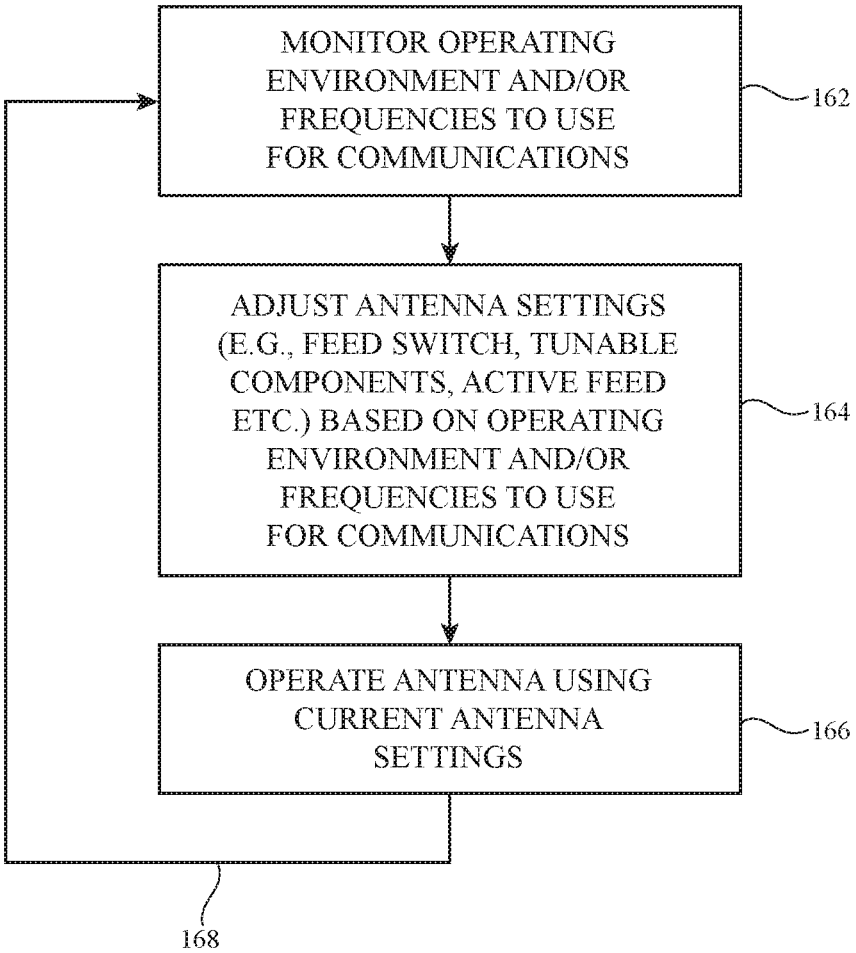
FIG. 10 is a flow chart of illustrative steps that may be involved in adjusting an antenna of the type shown in FIG. 8 in accordance with an embodiment.

FIG. 10 is a flow chart of illustrative steps involved in operating device 10 to ensure satisfactory performance for antenna 40-4 of FIG. 8 in all desired frequency bands of interest.

At step 162 of FIG. 10, control circuitry 28 may monitor the operating environment of device 10 and/or frequencies to use for performing wireless communications. The frequencies to use may be determined based on software running on control circuitry 28 (e.g., software controlling wireless communications for device 10) and/or based on an assignment received from external equipment like a wireless base station.

Control circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as temperature sensors, capacitive proximity sensors, light-based proximity sensors, resistance sensors, force sensors, touch sensors, connector sensors that sense the presence of a connector in a connector port or that detect the presence or absence of data transmission through a connector port, sensors that detect whether wired or wireless headphones are being used with device 10, sensors that identify a type of headphone or accessory device that is being used with device 10 (e.g., sensors that identify an accessory identifier identifying an accessory that is being used with device 10), or other sensors to determine how device 10 is being used. Control circuitry 28 may also use information from an orientation sensor such as an accelerometer in device 10 to help determine whether device 10 is being held in a position characteristic of right hand use or left hand use (or is being operated in free space). Control circuitry 28 may also use information about a usage scenario of device 10 in determining how device 10 is being used (e.g., information identifying whether audio data is being transmitted through ear speaker 8 of FIG. 1, information identifying whether a telephone call is being conducted, information identifying whether a microphone on device 10 is receiving voice signals, etc.).

If desired, an impedance sensor or other sensor may be used in monitoring the impedance of antenna 40-4 or part of antenna 40-4. Different antenna loading scenarios may load antenna 40-4 differently, so impedance measurements may help determine whether device 10 is being gripped by a user's left or right hand or is being operated in free space. Another way in which control circuitry 28 may monitor antenna loading conditions involves making received signal strength measurements on radio-frequency signals being received with antenna 40-4. In this example, the adjustable circuitry of antenna 40-4 can be toggled between different settings and an optimum setting for antenna 40-4 can be identified by choosing a setting that maximizes received signal strength. In general, any desired combinations of one or more of these measurements or other measurements may be processed by control circuitry 28 to identify how device 10 is being used (i.e., to identify the operating environment of device 10).

At step 164, control circuitry 28 may adjust the configuration of antenna 40-4 (e.g., antenna settings for antenna 40-4) based on the current operating environment of device 10 and/or the frequencies to use for communications (e.g., based on data or information gathered while processing step 162). Control circuitry 28 may place antenna 40-4 into one of the first and second operating modes using adjustable component 102C of FIG. 8 and may adjust components 102A, 102B, 102D, and/or 102E to further adjust the frequency response of antenna 40-4 based on the information gathered while processing step 162 of FIG. 10.

At step 166, antenna 40-4 may be used to transmit and receive wireless data using the antenna settings selected at step 164. This process may be performed continuously, as indicated by path 168. In this way, antenna 40-4 may be dynamically adjusted in real time based on the operating environment and needs of device 10. Similar steps may be used to adjust antennas 40-1, 40-2, 40-3, and/or other antennas 40 in device 10 if desired.

Figure 11:
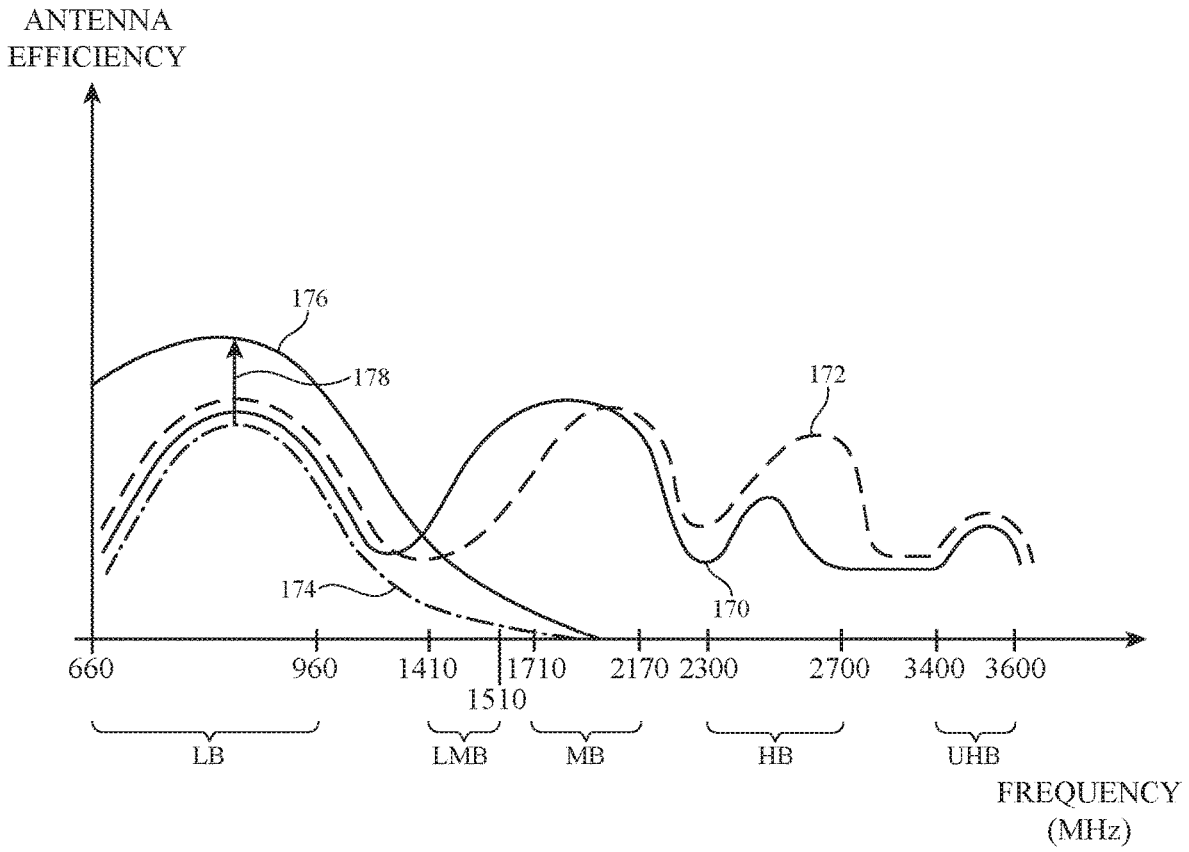
FIG. 11 is a plot of antenna performance (antenna efficiency) of an illustrative antenna of the type shown in FIG. 8 in accordance with an embodiment.

FIG. 11 is a graph in which antenna performance (antenna efficiency) has been plotted as a function of operating frequency for antenna 40-4 of FIG. 8. As shown in FIG. 11, curve 170 plots an exemplary antenna efficiency of antenna 40-4 while antenna 40-4 is in the first operating mode and while adjustable component 102E forms an open circuit (e.g., while positive antenna feed terminal 46B is active and positive antenna feed terminals 46A and 46C are inactive).

When placed in this configuration, the length of resonating element arm 66 between positive antenna feed terminal 46A and gap 18-2 (FIG. 8) may support a response peak in a first frequency band such as cellular low band LB (e.g., a frequency band between about 600 MHz and 960 MHz). The length of resonating element arm 66 between positive antenna feed terminal 46B and gap 18-2 may support a response peak that extends across a second frequency band such as cellular low-midband LMB (e.g., a frequency band between about 1410 MHz and 1510 MHz) and a third frequency band such as cellular midband MB (e.g., a frequency band between about 1710 MHz and 2170 MHz). The end (tip) of resonating element arm 66 may indirectly feed segment 16-4 of peripheral conductive housing structures 16 to support a response peak in a fourth frequency band such as cellular high band HB (e.g., a frequency band between about 2300 MHz and 2700 MHz). A harmonic mode of the portion of resonating element arm 66 between positive antenna feed terminal 46B and gap 18-2 may support a response peak in a fifth frequency band such as cellular ultra-high band UHB (e.g., a frequency band between about 3400 MHz and 3600 MHz). Control circuitry 28 may adjust components 102A and/or 102B to adjust the frequency response in cellular low band LB and may adjust component 102D to adjust the frequency response in cellular midband MB, cellular high band HB, and/or cellular ultra-high band UHB.

As shown by curve 170 of FIG. 11, the response peak in cellular high band HB may only cover relatively low frequencies in cellular high band HB without providing satisfactory efficiency at higher frequencies in cellular high band HB. In order to cover the entirety of cellular high band HB with satisfactory efficiency, control circuitry 28 may control adjustable component 102E to activate positive antenna feed terminal 46C (e.g., to directly feed vertical slot 120).

Curve 172 plots an exemplary antenna efficiency of antenna 40-4 while antenna 40-4 is in the first operating mode and while positive antenna feed terminal 46C is active. When placed in this configuration, vertical slot 120 is directly fed over positive antenna feed terminal 46C and path 106 of FIG. 8. This may serve to pull the coverage of antenna 40-4 in cellular high band HB to higher frequencies as well as to increase the overall efficiency of antenna 40-4 within cellular high band HB.

Directly feeding vertical slot 120 as shown by curve 172 of FIG. 11 may also reduce antenna efficiency within the second frequency band (e.g., within cellular low-midband LMB). If desired, control circuitry 28 may adjust component 102D of FIG. 8 to pull the frequency response of antenna 40-4 downwards to also cover cellular low-midband LMB without substantially affecting coverage in cellular high band HB. Control circuitry 28 may adjust components 102A and/or 102B to adjust the frequency response in cellular low band LB and may adjust component 102D to adjust the frequency response in cellular low-midband LMB, cellular midband MB, cellular high band HB, and/or cellular ultra-high band UHB.

Curve 174 of FIG. 11 plots the antenna efficiency of antenna 40-4 in scenarios where positive antenna feed terminal 46A is fed using a dedicated transmission line or in scenarios where node 100 is coupled to node 130 (FIG. 8) by a wire or other thin conductive line having insufficient width. In scenarios where positive antenna feed terminal 46A is fed using a dedicated transmission line, attenuation from the dedicated transmission line and the associated additional switching circuitry limits the peak antenna efficiency in cellular low band LB. In scenarios where node 100 is coupled to node 130 by a wire or other thin conductive line having insufficient width, the inductance associated with the relatively long electrical path length from signal conductor 52 to positive antenna feed terminal 46A limits the peak antenna efficiency in cellular low band LB.

Curve 176 of FIG. 11 plots an exemplary antenna efficiency of antenna 40-4 while antenna 40-4 is placed in the second operating mode (e.g., when positive antenna feed terminal 46A is active and positive antenna feed terminals 46B and 46C are inactive). When placed in this configuration, electromagnetic hot spots in cellular low band LB are moved away from ground extension 80 (FIG. 8) without introducing attenuation associated with a dedicated transmission line and its switching circuitry and without introducing excessive inductance between signal conductor 52 and positive antenna feed terminal 46A. This may serve to increase the peak antenna efficiency and/or bandwidth of antenna 40-4 within cellular low band LB, as shown by arrow 178.

The example of FIG. 11 is merely illustrative. In general, antenna 40-4 may cover any desired bands at any desired frequencies (e.g., antenna 40-4 may exhibit any desired number of efficiency peaks extending over any desired frequency bands). Curves 170, 172, 174, and 176 may have other shapes if desired.

In this way, device 10 may be provided with a display 14 (FIG. 1) having an active area AA that extends across substantially all of the front face of device 10. Antenna 40-4 may be provided with satisfactory antenna efficiency across multiple frequency bands of interest despite the presence of the conductive display structures used to support such a large active area AA for display 14. Antenna 40-4 may operate using a carrier aggregation scheme across one or more of these frequency bands and using a MIMO scheme with the other antennas in device 10 to maximize wireless data throughput for device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a housing having peripheral conductive housing structures;

ground structures;

an antenna having a resonating element arm formed from a segment of the peripheral conductive housing structures that is separated from the ground structures by a slot;

a radio-frequency transmission line having a ground conductor coupled to the ground structures and having a signal conductor coupled to the segment; and an adjustable component that is configured to tune a frequency response of the antenna and that has a first terminal coupled to the signal conductor, a second terminal coupled to the segment, and a third terminal coupled to the ground structures, wherein the adjustable component is configurable to decouple the first terminal from the second terminal and to form a return path between the second terminal and the third terminal.

2. The electronic device defined in claim 1, further comprising:

a dielectric-filled gap in the peripheral conductive housing structures that separates the resonating element arm from an additional segment of the peripheral conductive housing structures.

3. The electronic device defined in claim 2, wherein the ground conductor is coupled to the ground structures at a ground antenna feed terminal, the signal conductor is coupled to a first positive antenna feed terminal on the segment, and the electronic device further comprises:

a conductive path coupled between the first positive antenna feed terminal and a second positive antenna feed terminal on the additional segment.

4. The electronic device defined in claim 3, further comprising:

an additional adjustable component interposed on the conductive path, wherein the additional adjustable component has a first state in which the resonating element arm is configured to indirectly feed radio-frequency signals to the additional segment via near field electromagnetic coupling, and the additional adjustable component has a second state in which the second positive antenna feed terminal conveys antenna currents from the signal conductor to the additional segment.

5. The electronic device defined in claim 4, wherein the additional adjustable component is configured to tune the frequency response of the antenna by coupling a selected inductance between the signal conductor and the second positive antenna feed terminal.

6. The electronic device defined in claim 3, further comprising:

radio-frequency transceiver circuitry coupled to the radio-frequency transmission line; and a switch interposed on the signal conductor, wherein the switch is coupled between the radio-frequency transceiver circuitry and the first terminal of the adjustable component.

7. The electronic device defined in claim 6, further comprising:

a third positive antenna feed terminal on the segment; and a conductive trace over the slot and coupled between a node on the signal conductor and the third positive antenna feed terminal, wherein the node is interposed between the radio-frequency transceiver circuitry and the switch.

8. The electronic device defined in claim 7, wherein the switch has a first state in which the third positive antenna feed terminal is active and the first and second positive antenna feed terminals are inactive and has a second state in which the first positive antenna feed terminal is active and the third positive antenna feed terminal is inactive.

9. An electronic device comprising:

a housing having peripheral conductive housing structures;

ground structures, wherein a segment of the peripheral conductive housing structures is separated from the ground structures by a slot;

an antenna that comprises the ground structures, a resonating element arm formed from the segment, a ground antenna feed terminal coupled to the ground structures, and first and second positive antenna feed terminal coupled to the segment;

radio-frequency transceiver circuitry in the housing;

a radio-frequency transmission line coupled to the radio-frequency transceiver circuitry, wherein the radio-frequency transmission line comprises a ground conductor coupled to the ground antenna feed terminal and a signal conductor coupled to the first positive antenna feed terminal;

a switch interposed on the signal conductor; and a conductive trace over the slot and coupled between a node on the signal conductor and the second positive antenna feed terminal, the node being interposed on the signal conductor between the switch and the radio-frequency transceiver circuitry.

10. The electronic device defined in claim 9, wherein the conductive trace is separated from the ground structures by a first distance and is separated from the segment by a second distance that is less than the first distance.

11. The electronic device defined in claim 9, wherein the conductive trace has a first end coupled to the node, an opposing second end coupled to the second positive antenna feed terminal, a length extending from the first end to the second end, and a width, the length being between two and ten times the width.

12. The electronic device defined in claim 11, further comprising:

an adjustable inductor coupled between the second end of the conductive trace and the ground structures.

13. The electronic device defined in claim 9, further comprising:

a dielectric-filled gap in the peripheral conductive housing structures that separates the resonating element arm from an additional segment of the peripheral conductive housing structures, wherein the antenna further comprises a third positive antenna feed terminal coupled to the additional segment and a conductive path coupled between the first positive antenna feed terminal and the third positive antenna feed terminal.

14. The electronic device defined in claim 13, further comprising:

an adjustable component interposed on the conductive path, wherein a portion of the slot extends between the additional segment and the ground structures, the adjustable component having a first state in which the resonating element arm is configured to indirectly feed radio-frequency signals to the additional segment via near field electromagnetic coupling and a second state in which the third positive antenna feed terminal conveys antenna currents from the signal conductor to the additional segment.

15. The electronic device defined in claim 13, wherein the switch has an open state and a closed state, the segment and the second positive antenna feed terminal are configured to convey radio-frequency signals in a first frequency band while the switch is in the open state, the segment and the first positive antenna feed terminal are configured to convey radio-frequency signals in the first frequency band and a second frequency band that is higher than the first frequency band while the switch is in the closed state, and the additional segment and the third positive antenna feed terminal are configured to convey radio-frequency signals in a third frequency band that is higher than the second frequency band while the switch is in the closed state.

16. An antenna configured to receive radio-frequency signals from a radio-frequency transmission line having a signal conductor, the antenna comprising:

ground structures;

a resonating element arm separated from the ground structures by a slot, wherein the slot comprises a portion extending between the ground structures and a conductive structure, the conductive structure being separated from the resonating element arm by a dielectric-filled gap; and an antenna feed configured to convey the radio-frequency signals received from the radio-frequency transmission line, wherein the antenna feed has a ground antenna feed terminal coupled to the ground structures, first and second positive antenna feed terminals coupled the antenna resonating element arm, and a third positive antenna feed terminal coupled to the conductive structure.

17. The antenna defined in claim 16, further comprising:

a conductive trace over the slot and coupled between a node on the signal conductor and the second positive antenna feed terminal; and a switch coupled between the node and the first positive antenna feed terminal.

18. The antenna defined in claim 17, further comprising:

a conductive path coupled between the first positive antenna feed terminal and the third positive antenna feed terminal; and an adjustable component interposed on the conductive path, wherein the switch has open and closed states and the adjustable component has first and second states, the resonating element arm is configured to radiate in a first frequency band while the switch is in the open state, the resonating element arm is configured to radiate in the first frequency band and a second frequency band that is higher than the first frequency band while the switch is in the closed state, the conductive structure is configured to radiate in a third frequency band that is higher than the second frequency band while the switch is in the closed state and the adjustable component is in the first state, and the portion of the slot is configured to radiate in the third frequency band while the switch is in the closed state and the adjustable component is in the second state.

19. The electronic device defined in claim 1, wherein the adjustable component is configured, in a state, to form an open circuit between the first terminal and the second terminal by decoupling the first terminal from the second terminal and to form the return path between the second terminal and the third terminal.

20. The electronic device defined in claim 19, wherein the adjustable component is configured, in an additional state, to couple an impedance element between the first terminal and the third terminal and to form an open circuit between the second terminal and the third terminal.

* * * * *